US010537154B2

(12) United States Patent
Smith et al.

(10) Patent No.: US 10,537,154 B2
(45) **Date of Patent: *Jan. 21, 2020**

(54) ARTICLE OF FOOTWEAR WITH WEIGHT-ACTIVATED CINCHING APPARATUS

(71) Applicant: NIKE, Inc., Beaverton, OR (US)

(72) Inventors: Casey L. Smith, Oregon City, OR (US); Michael R. Friton, Portland, OR (US)

(73) Assignee: NIKE, Inc., Beaverton, OR (US)

( * ) Notice: Subject to any disclaimer, the term of this patent is extended or adjusted under 35 U.S.C. 154(b) by 251 days.

This patent is subject to a terminal disclaimer.

(21) Appl. No.: 15/816,299

(22) Filed: Nov. 17, 2017

(65) Prior Publication Data

US 2018/0070679 A1 Mar. 15, 2018

Related U.S. Application Data

(63) Continuation of application No. 14/686,253, filed on Apr. 14, 2015, now Pat. No. 9,848,674.

(51) Int. Cl.
*A43C 11/00* (2006.01)
*A43C 11/16* (2006.01)
(Continued)

(52) U.S. Cl.
CPC ..... *A43C 11/004* (2013.01); *A43B 17/02* (2013.01); *A43C 11/00* (2013.01); *A43C 11/165* (2013.01);
(Continued)

(58) Field of Classification Search
CPC ..... A43C 11/004; A43C 11/00; A43C 11/165
See application file for complete search history.

(56) References Cited

U.S. PATENT DOCUMENTS 3,070,907 A 1/1963 Rocco
3,893,247 A 7/1975 Dana, III
(Continued)

FOREIGN PATENT DOCUMENTS

JP 5392939 10/2013
WO 200339283 5/2003

OTHER PUBLICATIONS

International Preliminary Report on Patentability, dated Nov. 11, 2010, for PCT Application No. PCT/US2009/042075.
(Continued)

*Primary Examiner* — Megan E Lynch
(74) *Attorney, Agent, or Firm* — Banner & Witcoff, Ltd.

(57) ABSTRACT

An article of footwear is disclosed that includes a cinching apparatus that is configured to move the upper between an open position and a closed position. The cinching apparatus includes a spring pad with a first, second, and third portion. The third portion is elastic and configured to deform elastically from a first position toward a second position. The third portion is configured to move the first portion relative to the second portion generally in the longitudinal direction as the third portion deforms between the first position and the second position. Also, the cinching apparatus is configured to move the upper from the open position toward the closed position as the third portion of the spring pad moves from the first position toward the second position.

22 Claims, 12 Drawing Sheets

(51) Int. Cl.

| | |
|---|---|
| ***A43B 17/02*** | (2006.01) |
| *A43B 13/18* | (2006.01) |
| *A43B 7/14* | (2006.01) |
| *A43B 11/00* | (2006.01) |
| *A43B 17/00* | (2006.01) |
| *A43B 19/00* | (2006.01) |

(52) U.S. Cl.

CPC ..... *A43B 7/142* (2013.01); *A43B 11/00* (2013.01); *A43B 13/181* (2013.01); *A43B 13/183* (2013.01); *A43B 17/00* (2013.01); *A43B 19/00* (2013.01)

(56) References Cited

U.S. PATENT DOCUMENTS

| | | | | |
|---|---|---|---|---|
| 3,946,505 | A | 3/1976 | Dana, III | |
| 4,020,572 | A | 5/1977 | Chiaramonte, Jr. | |
| 4,158,922 | A | 6/1979 | Dana, III | |
| 4,253,253 | A | 3/1981 | McCormick | |
| 4,426,796 | A | 1/1984 | Spademan | |
| 4,433,456 | A | 2/1984 | Baggio | |
| 4,494,324 | A | 1/1985 | Spademan | |
| 4,619,057 | A | 10/1986 | Sartor et al. | |
| 4,644,671 | A | 2/1987 | Walkhoff | |
| 4,670,999 | A | 6/1987 | Olivieri | |
| 4,895,110 | A | 1/1990 | LoCascio | |
| 4,924,605 | A * | 5/1990 | Spademan | A43B 5/00 36/114 |
| 4,999,936 | A | 3/1991 | Calamia et al. | |
| 5,060,402 | A | 10/1991 | Rosen | |
| 5,174,051 | A | 12/1992 | Walkhoff et al. | |
| 5,188,447 | A | 2/1993 | Chiang et al. | |
| 5,205,055 | A | 4/1993 | Harrell | |
| 5,245,516 | A | 9/1993 | de Haas et al. | |
| 5,282,327 | A | 2/1994 | Ogle | |
| 5,285,586 | A | 2/1994 | Goldston et al. | |
| 5,303,131 | A | 4/1994 | Wu | |
| 5,303,485 | A | 4/1994 | Goldston et al. | |
| 5,311,677 | A | 5/1994 | Mann et al. | |
| 5,311,678 | A | 5/1994 | Spademan | |
| 5,373,651 | A | 12/1994 | Wood | |
| 5,396,718 | A | 3/1995 | Schuler et al. | |
| 5,469,342 | A | 11/1995 | Chien | |
| 5,479,325 | A | 12/1995 | Chien | |
| 5,481,814 | A | 1/1996 | Spencer | |
| 5,495,136 | A | 2/1996 | Chiang et al. | |
| 5,500,635 | A | 3/1996 | Mott | |
| 5,546,681 | A | 8/1996 | Goldston et al. | |
| 5,570,945 | A | 11/1996 | Chien et al. | |
| 5,611,621 | A | 3/1997 | Chien | |
| 5,644,858 | A | 7/1997 | Bemis | |
| 5,692,324 | A | 12/1997 | Goldston et al. | |
| 5,704,705 | A | 1/1998 | Chien | |
| 5,704,706 | A | 1/1998 | Goldston et al. | |
| 5,791,068 | A * | 8/1998 | Bernier | A43B 1/0072 36/50.1 |
| 5,829,169 | A | 11/1998 | James | |
| 5,839,210 | A * | 11/1998 | Bernier | A43B 1/0072 36/50.1 |
| 5,865,523 | A | 2/1999 | Chien | |
| 5,950,335 | A | 9/1999 | Okajima | |
| 5,983,530 | A * | 11/1999 | Chou | A43C 1/04 36/118.1 |
| 6,032,387 | A * | 3/2000 | Johnson | A43C 1/06 36/118.1 |
| 6,035,556 | A | 3/2000 | Ballinger et al. | |
| 6,189,239 | B1 | 2/2001 | Gasparovic et al. | |
| 6,199,305 | B1 | 3/2001 | Steuerwald et al. | |
| 6,378,230 | B1 * | 4/2002 | Rotem | A43C 11/16 36/118.1 |
| 6,427,361 | B1 * | 8/2002 | Chou | A43B 11/00 36/138 |
| 6,467,194 | B1 | 10/2002 | Johnson | |
| 6,643,954 | B2 * | 11/2003 | Voswinkel | A43B 11/00 36/138 |
| 6,691,433 | B2 | 2/2004 | Liu | |
| 6,896,128 | B1 * | 5/2005 | Johnson | A43C 1/06 36/118.1 |
| 6,925,734 | B1 | 8/2005 | Schaeffer | |
| 6,952,891 | B2 | 10/2005 | Hirayama | |
| 7,059,069 | B2 | 6/2006 | Raluy et al. | |
| 7,103,994 | B2 | 9/2006 | Johnson | |
| 7,255,468 | B2 | 8/2007 | Capriola | |
| 7,395,614 | B1 | 7/2008 | Bailey, Sr. et al. | |
| 7,503,131 | B2 | 3/2009 | Nadel et al. | |
| 7,510,293 | B2 | 3/2009 | Chyn | |
| 7,721,468 | B1 * | 5/2010 | Johnson | A43C 1/06 36/118.1 |
| 7,752,774 | B2 | 7/2010 | Ussher | |
| 7,794,101 | B2 | 9/2010 | Galica et al. | |
| 8,046,937 | B2 * | 11/2011 | Beers | A43B 3/0005 36/50.1 |
| 8,087,188 | B2 | 1/2012 | Labbe | |
| 2003/0066207 | A1 | 4/2003 | Gaither | |
| 2004/0016148 | A1 * | 1/2004 | Chen | A43B 17/02 36/44 |
| 2005/0188566 | A1 * | 9/2005 | Whittlesey | A43B 3/0005 36/127 |
| 2005/0198867 | A1 * | 9/2005 | Labbe | A43B 11/00 36/50.1 |
| 2005/0235523 | A1 | 10/2005 | Flechsig et al. | |
| 2006/0053659 | A1 * | 3/2006 | Johnson | A43B 11/00 36/56 |
| 2006/0156517 | A1 | 7/2006 | Hammerslag et al. | |
| 2007/0011914 | A1 | 1/2007 | Keen et al. | |
| 2007/0011919 | A1 | 1/2007 | Case, Jr. | |
| 2007/0028486 | A1 | 2/2007 | Montanya et al. | |
| 2007/0209234 | A1 * | 9/2007 | Chou | A43B 11/00 36/50.1 |
| 2007/0267398 | A1 | 11/2007 | McCoy et al. | |
| 2008/0054845 | A1 | 3/2008 | Wang | |
| 2008/0060224 | A1 | 3/2008 | Whittlesey et al. | |
| 2008/0086911 | A1 * | 4/2008 | Labbe | A43B 11/00 36/50.1 |
| 2008/0197126 | A1 | 8/2008 | Bourke et al. | |
| 2008/0246439 | A1 | 10/2008 | Tsui et al. | |
| 2008/0301919 | A1 * | 12/2008 | Ussher | A43B 3/0005 24/712.7 |
| 2010/0033321 | A1 | 2/2010 | Kaminski et al. | |
| 2010/0115799 | A1 | 5/2010 | Welter et al. | |
| 2011/0258876 | A1 * | 10/2011 | Baker | A43C 11/008 36/50.1 |
| 2014/0298687 | A1 | 10/2014 | Flinterman et al. | |

OTHER PUBLICATIONS

Back to the Future Part II (Universal Pictures 1989), first appearance of shoes at 8:06, see also Feature Commentary with Producers Bob Gale and Neil Canton at 8:06-8:32.

International Search Report and Written Opinion, dated Jul. 27, 2009, for PCT Application No. PCT/US2009/42072.

International Search Report and Written Opinion, dated Jul. 27, 2009, for PCT Applicaton No. PCT/US2009/42075.

International Preliminary Report on Patentability, dated Nov. 11, 2010, for PCT Application No. PCT/US2009/042072.

* cited by examiner

ARTICLE OF FOOTWEAR WITH WEIGHT-ACTIVATED CINCHING APPARATUS

CROSS REFERENCE TO RELATED APPLICATIONS

This application is a continuation of co-pending U.S. patent application Ser. No. 14/686,253 filed on Apr. 14, 2015 entitled "Article of Footwear with Weight-Activated Cinching Apparatus" the entire contents of which is incorporated herein in its entirety by reference.

BACKGROUND

Conventional articles of footwear generally include two primary elements: an upper and a sole structure. The upper is secured to the sole structure and forms a void for comfortably and securely receiving a foot. The sole structure is secured to a lower area of the upper, thereby being positioned between the upper and the ground.

In some embodiments, the sole structure includes a midsole and an outsole. The midsole often includes a polymeric foam material that attenuates ground reaction forces to lessen stresses upon the foot and leg during walking, running, and other ambulatory activities. Additionally, the midsole may include fluid-filled chambers, plates, moderators, or other elements that further attenuate forces, enhance stability, or influence the motions of the foot. The outsole is secured to a lower surface of the midsole and provides a ground-engaging portion of the sole structure formed from a durable and wear-resistant material, such as rubber.

The upper can generally extend over the instep and toe areas of the foot, along the medial and lateral sides of the foot and around the heel area of the foot. In some articles of footwear, the upper may extend upward and around the ankle to provide support or protection for the ankle. Access to the void within the upper is generally provided by an ankle opening in a heel region of the footwear.

Additionally, the article of footwear can include a lacing system, cables, straps, buckles, or other securement device. The securement device can cinch, tighten, or close the upper onto the foot. Conversely, the securement device can uncinch, loosen, or open up the upper relative to the foot. The securement device also permits the wearer to modify certain dimensions of the upper, particularly girth, to accommodate feet with varying dimensions.

SUMMARY

An article of footwear is disclosed that includes a forefoot region and a heel region. The article of footwear defines a longitudinal direction that extends generally between the forefoot region and the heel region. The article of footwear includes an upper having an open position and a closed position. The article of footwear also includes a cinching apparatus that is configured to move the upper between the open and closed positions. The cinching apparatus includes a spring pad with a first portion, a second portion, and a third portion. The first portion and the second portion are spaced apart at a distance generally in the longitudinal direction. The third portion is disposed between the first portion and the second portion. The third portion is elastic and configured to deform elastically from a first position toward a second position. The third portion is configured to move the first portion relative to the second portion generally in the longitudinal direction as the third portion deforms between the first position and the second position. The distance is greater in the second position than in the first position. Also, the cinching apparatus is configured to move the upper from the open position toward the closed position as the third portion of the spring pad moves from the first position toward the second position.

In addition, an article of footwear is disclosed that includes a forefoot region and a heel region. The article of footwear defines a longitudinal direction that extends generally between the forefoot region and the heel region. The article of footwear includes an upper having a closed position and an open position. The article of footwear further includes a cinching apparatus configured to move the upper between the closed position and the open position. The cinching apparatus includes a base and a spring pad. The spring pad has a heel portion, a forefoot portion, and an intermediate portion that is disposed between the heel portion and the forefoot portion. The intermediate portion is elastic and configured to resiliently deform between a first position and a second position relative to the base. One of the heel portion and the forefoot portion is fixed to the base. The other of the heel portion and the forefoot portion is configured to slide along the base in the longitudinal direction as the intermediate portion moves between the first position and the second position. The upper is configured to move between the open position and the closed position as the intermediate portion moves between the first position and the second position.

In addition, an article of footwear configured to be worn on a foot of a wearer is disclosed. The article of footwear includes an upper having an open position and a closed position. The article of footwear also includes a securement device attached to the upper and configured to move the upper between the open position and the closed position. The footwear also includes a sole structure that includes a base with a first side and a second side. The first side is opposite the second side. The second side includes a rail with a groove. The base also includes an opening and a latch. The sole structure also includes an abutment member that is received within the groove. The abutment member is configured to slide along the rail within the groove. Moreover, the sole structure includes a spring pad that is supported by the first side of the base. The spring pad is elastic and bendable, and the spring pad is configured to elastically bend between a first position and a second position. The sole structure additionally includes a first attachment at which the spring pad and the base are fixed together and a second attachment at which the spring pad and the abutment member are fixed through the opening in the base. A distance between the first attachment and the second attachment vary as the spring pad bends between the first position and the second position. The second attachment is configured to move within the opening as the spring pad bends between the first position and the second position. Also, the spring pad is configured to slide the abutment member along the rail as the spring pad bends between the first position and the second position. The sole structure further includes a shuttle that engages the securement device and that is received within the groove. The shuttle is configured to slide along the rail within the groove. The shuttle has a retained position and a released position. The shuttle is latched to the latch of the base in the retained position. The shuttle is configured to move relative to the base along the groove in the released position. The sole structure additionally includes a biasing member that is connected to the second attachment and the shuttle. The biasing member biases the shuttle toward the released position. The spring pad is configured to elastically bend due to a weight load of the wearer from the first position toward the second position causing the abutment member to slide and release the shuttle from the retained position to the released position, which allows the shuttle to pull the securement device to move the upper from the open position toward the closed position. The spring pad is biased toward the first position such that the spring pad is configured to elastically recover to the first position to move the upper from the closed position toward the open position.

Other systems, methods, features and advantages of the present disclosure will be, or will become, apparent to one of ordinary skill in the art upon examination of the following figures and detailed description. It is intended that all such additional systems, methods, features and advantages be included within this description and this summary, be within the scope of the present disclosure, and be protected by the following claims.

BRIEF DESCRIPTION OF THE DRAWINGS

The present disclosure can be better understood with reference to the following drawings and description. The components in the figures are not necessarily to scale, emphasis instead being placed upon illustrating the principles of the present disclosure. Moreover, in the figures, like reference numerals designate corresponding parts throughout the different views.

DETAILED DESCRIPTION

Figure 1:
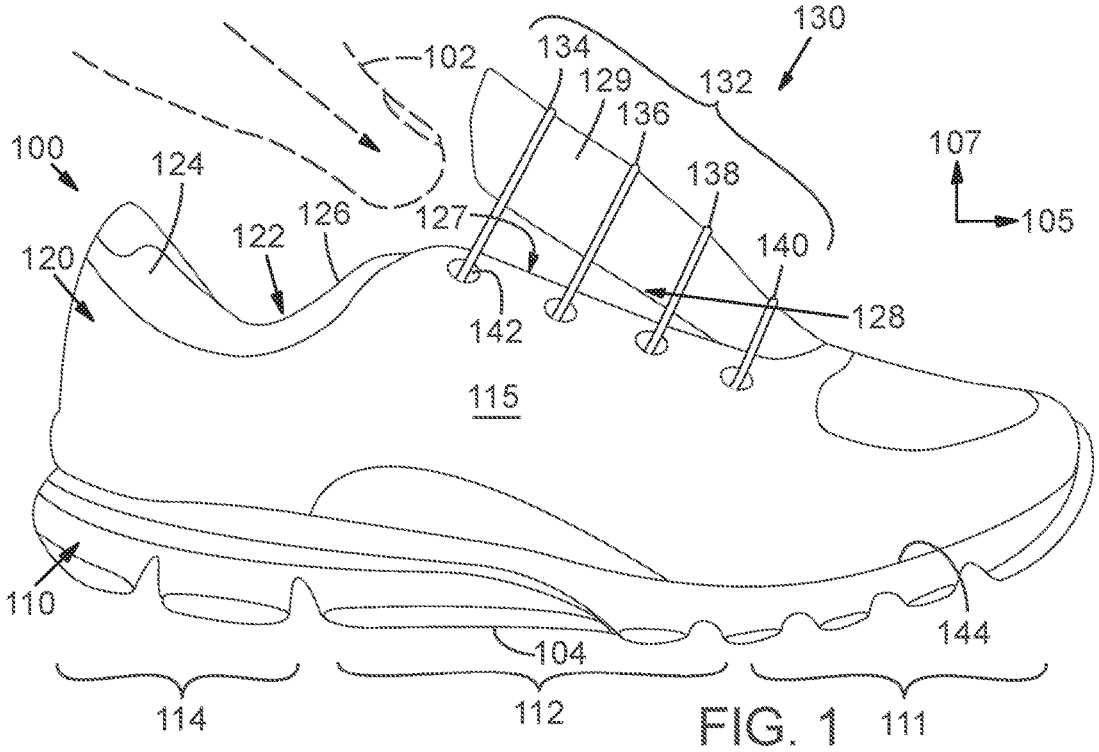
FIG. 1 is a medial side view of an article of footwear in an open position according to exemplary embodiments.

The following discussion and accompanying figures disclose a variety of concepts relating to an article of footwear with an apparatus that cinches, tightens, or closes the upper on the wearer's foot. The apparatus can also uncinch, loosen, or open the upper relative to the foot.

In some embodiments, the apparatus may include provisions for automatically adjusting the upper relative to the foot. For example, the apparatus can automatically close the upper onto the foot as the wearer steps into the footwear in some embodiments. Also, in some embodiments, the apparatus can automatically open up the upper relative to the foot to facilitate removal of the foot from the upper.

Furthermore, in some embodiments, the apparatus can include an elastic and deformable member that bends or otherwise elastically deforms under the weight of the wearer. The member can also resiliently recover when the weight load is reduced. This deformation can affect one or more other features for ultimately opening and closing of the upper. Stated differently, the deformable member can deform from a first position to a second position when weight is applied to close the upper. Also, in some embodiments, the deformable member can be biased toward the first position such that the deformable member recovers to the first position when the weight load is reduced. As a result of this elastic recovery, the upper can move toward the open position.

Referring initially to FIGS. 1-4, an exemplary embodiment of an article of footwear 100 is illustrated. A foot 102 is also shown in phantom. In some embodiments, footwear 100 can be a casual shoe, such as a tennis shoe. However, footwear 100 can also take the form of any other kind of footwear, including, for example, skates, boots, ski boots, snowboarding boots, cycling shoes, formal shoes, slippers or any other kind of footwear.

For reference purposes, footwear 100 may be divided into three general regions: a forefoot region 111, a midfoot region 112, and a heel region 114. Forefoot region 111 can generally include portions of footwear 100 corresponding with forward portions of the wearer's foot, including the toes and joints connecting the metatarsals with the phalanges. Midfoot region 112 can generally include portions of footwear 100 corresponding with middle portions of the wearer's foot, including an arch area. Heel region 114 can generally include portions of footwear 100 corresponding with rear portions of the wearer's foot, including the heel and calcaneus bone.

Figure 5:
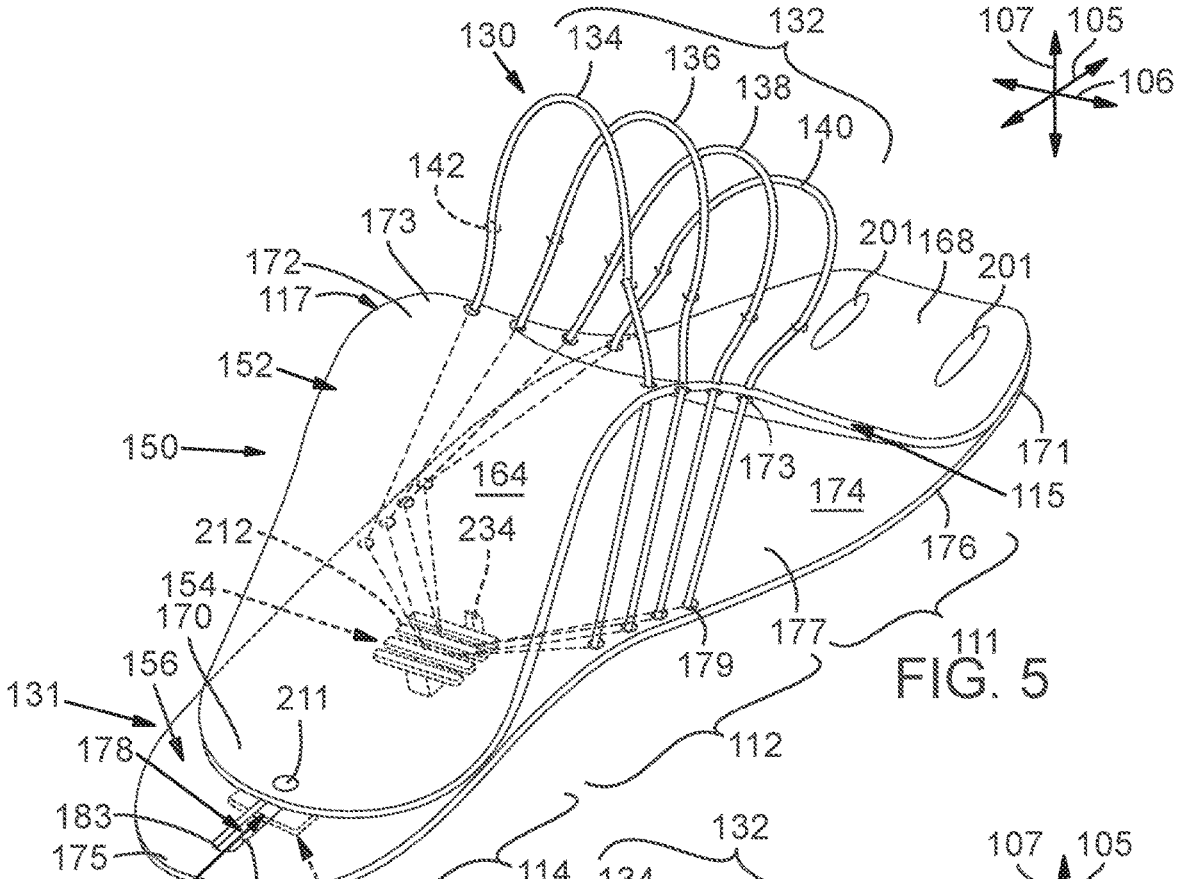
FIG. 5 is a perspective view of the cinching apparatus shown in the first position.

Footwear 100 can also include a medial side 115 and a lateral side 117. Medial side 115 is substantially shown in FIG. 1 and portions of lateral side 117 of footwear are shown in FIG. 5. Medial side 115 and lateral side 117 can extend through forefoot region 111, midfoot region 112, and heel region 114 in some embodiments. Medial side 115 and lateral side 117 can correspond with opposite sides of footwear 100. More particularly, medial side 115 can correspond with an inside area of the wearer's foot and can face toward the wearer's other foot. Lateral side 117 can correspond with an outside area of the wearer's foot and can face away from the wearer's other foot.

Forefoot region 111, midfoot region 112, heel region 114, lateral side 117, and medial side 115 are not intended to demarcate precise areas of footwear 100. Rather, forefoot region 111, midfoot region 112, heel region 114, lateral side 117, and medial side 115 are intended to represent general areas of footwear 100 to aid in the following discussion. These terms can also be used in reference to individual components of footwear 100.

Footwear 100 can also extend along various directions. For example, as shown in FIGS. 1-4, footwear 100 can extend along a longitudinal direction 105 and a vertical direction 107. A shown in FIG. 5, footwear 100 can further extend along a transverse direction 106. Longitudinal direction 105 can extend generally between heel region 114 and forefoot region 111. Transverse direction 106 can extend generally between lateral side 117 and medial side 115. Also, vertical direction 107 can extend substantially perpendicular to both longitudinal direction 105 and transverse direction 106. It will be appreciated that longitudinal direction 105, transverse direction 106, and vertical direction 107 are merely included for reference purposes and to aid in the following discussion.

Generally, footwear 100 can include a sole structure 110 and an upper 120. Upper 120 can receive the wearer's foot and secure footwear 100 to the wearer's foot whereas sole structure 110 can extend underneath upper 120 and support wearer.

Sole structure 110 can be secured to a lower area 144 of upper 120 and can extend between the wearer's foot and the ground when footwear 100 is worn. Sole structure 110 can support upper 120 and can support the wearer's foot 102. In some embodiments, sole structure 110 can include multiple components, such as an outsole, a midsole, and an insole. Also, sole structure 110 can define a ground-engaging surface 104. Ground-engaging surface 104 can also be referred to as a ground-contacting surface.

Additionally, upper 120 can define a void 122 that receives a foot of the wearer. When the wearer's foot is received within void 122, upper 120 can at least partially enclose and encapsulate the wearer's foot. Thus, upper 120 can extend about forefoot region 111, lateral side 117, heel region 114, and medial side 115 in some embodiments.

Upper 120 can also include a collar 124. Collar 124 can include a collar opening 126 that is configured to allow passage of the wearer's foot 102 during insertion or removal of the foot 102 from the void 122.

Upper 120 can also include a throat 128. Throat 128 can extend from collar opening 126 toward forefoot region 111. Throat 128 dimensions can be varied to change the width of footwear 100 between lateral side 117 and medial side 115. In some embodiments, such as the embodiment of FIG. 1, throat 128 can include a throat opening 127 that separates lateral side 117 and medial side 115. Throat opening 127 can extend from collar opening 126 toward forefoot region 111. In other embodiments, throat 128 can be continuous and uninterrupted between lateral side 117 and medial side 115.

In some embodiments, footwear 100 can also include a tongue 129 that is disposed within throat opening 127. For example, in some embodiments, the tongue 129 can be attached at its forward end to forefoot region 111, and the tongue 129 can be detached from medial side 115 and lateral side 117. Accordingly, the tongue 129 can substantially fill the throat opening 127.

Figure 2:
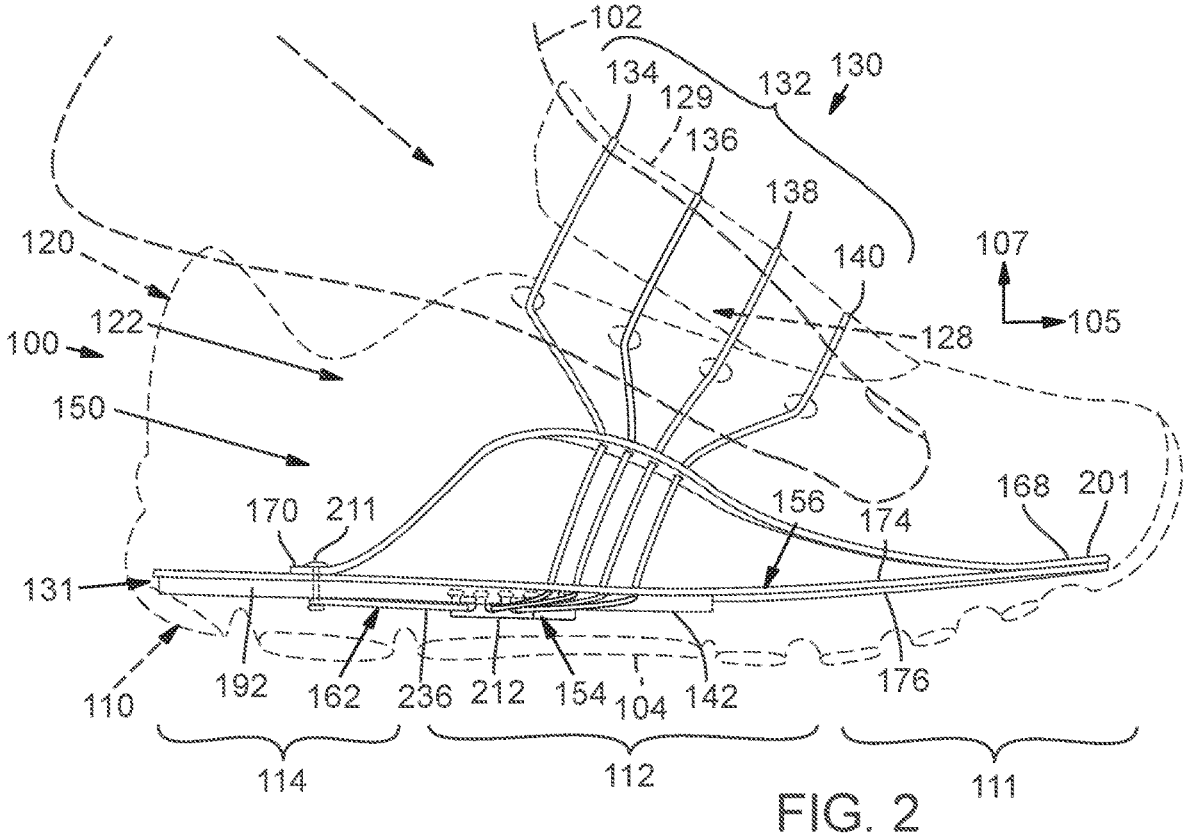
FIG. 2 is a medial side view of the article of footwear of FIG. 1 showing a weight-activated cinching apparatus according to exemplary embodiments, wherein the cinching apparatus is shown in a first position.
Figure 3:
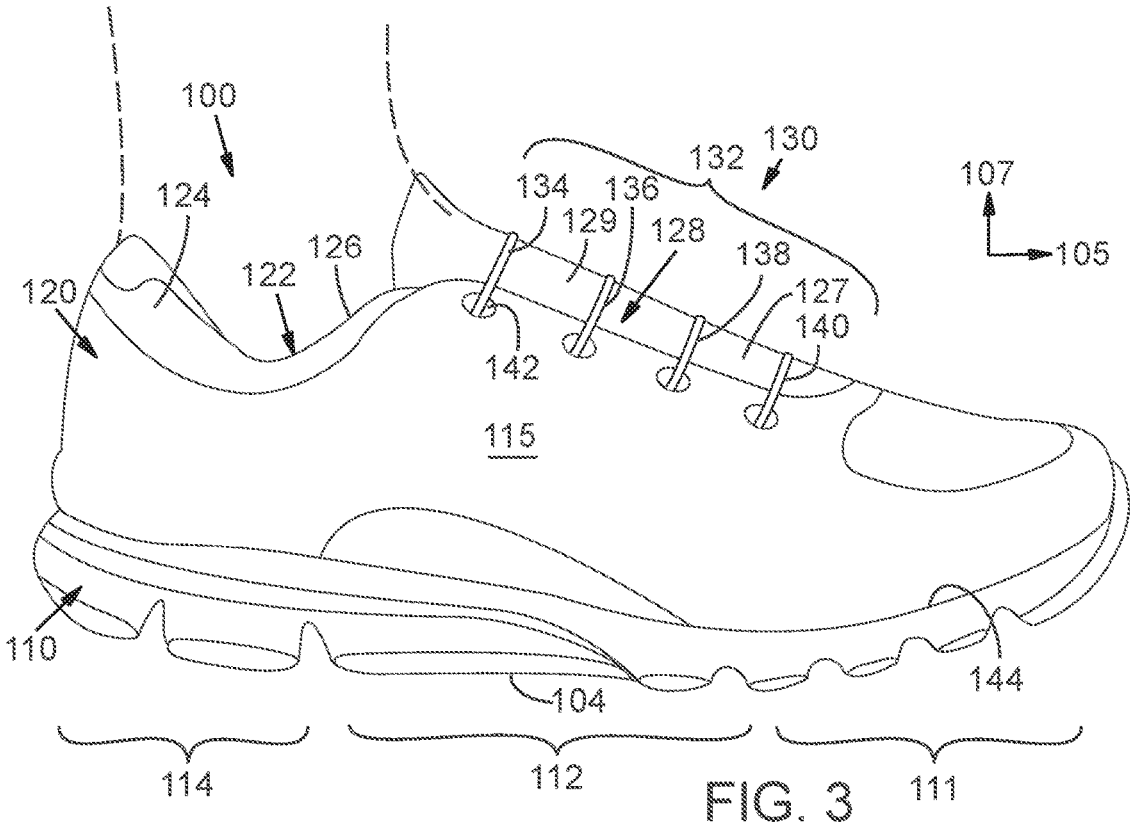
FIG. 3 is a medial side view of the article of footwear in a closed position according to exemplary embodiments.
Figure 4:
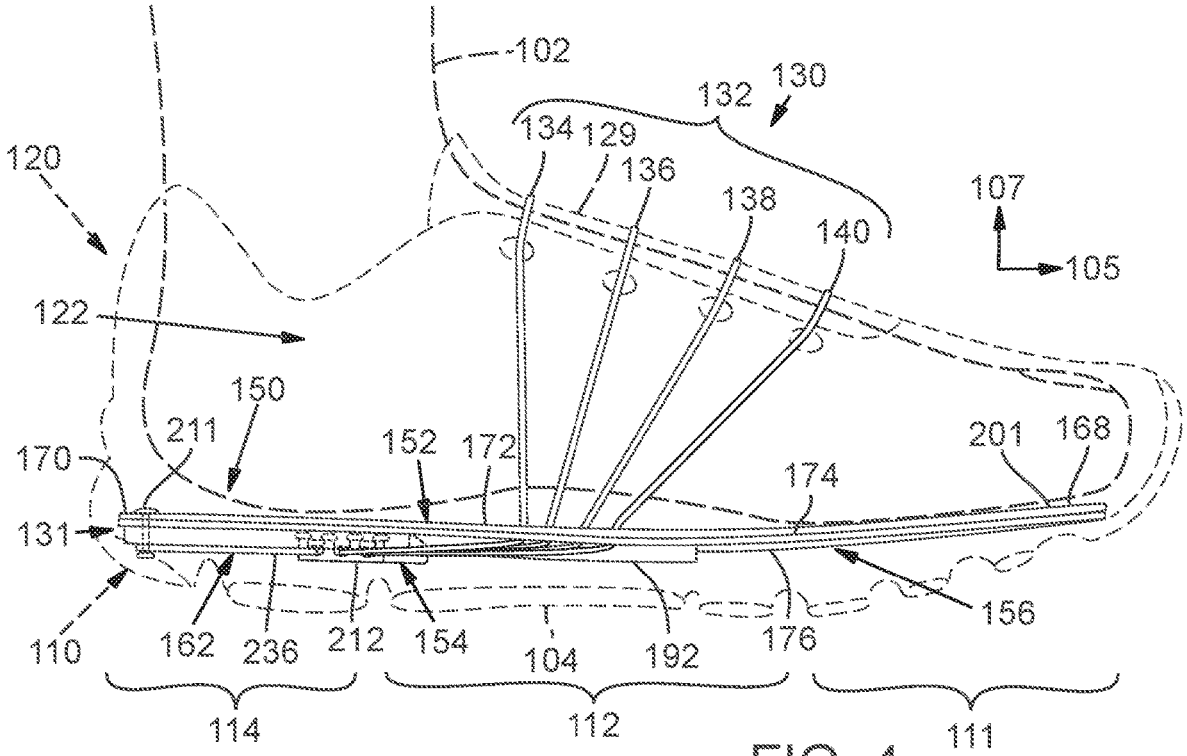
FIG. 4 is a medial side view of the article of footwear of FIG. showing the weight-activated cinching apparatus in a second position.

The upper 120 can move between various positions, such as an open position and a closed position. The open position is shown in FIGS. 1 and 2, and the closed position is shown in FIGS. 3 and 4 according to exemplary embodiments. In the open position, the void 122 within upper 120 can be larger than in the closed position. Thus, it can be easier for the wearer to move the foot 102 into the footwear 100 in the open position as compared to the closed position. Also, in some embodiments, the upper 120 can be tightly secured to the foot 102 when in the closed position.

In some embodiments, the tongue 129 can be pivoted away from adjacent areas of the upper 120 to allow passage of the foot 102 into and out of the upper 120. In the closed position, the tongue 129 can be pivoted toward adjacent areas of the upper 120 to secure the upper 120 to the foot 102. In some embodiments, the tongue 129 can pivot relative to the forefoot region 111 as the upper 120 moves between the open position and the closed position.

Article of footwear 100 can also include a cinching apparatus 150. Cinching apparatus 150 can be configured to move the upper 120 between the open position illustrated, for example, in FIGS. 1 and 2 and the closed position illustrated, for example, in FIGS. 3 and 4.

Generally, cinching apparatus 150 can include a securement device 130, such as shoelaces, wires, cables, straps, or other types of fastening structures. In some embodiments, securement device 130 can be tightened to close the upper 120 and secure the upper 120 to the foot 102. Also, securement device 130 can be loosened to open the upper 120 relative to the foot 102 in some embodiments.

Cinching apparatus 150 can also generally include an actuator system 131, which is shown in FIGS. 2 and 4 according to exemplary embodiments. Actuator system 131 can actuate the securement device 130 to ultimately move the upper 120 between the open position and the closed position. For example, actuator system 131 can selectively pull and tighten the securement device 130 for closing the upper 120. Conversely, the actuator system 131 can loosen the securement device 130 for opening the upper 120.

In some embodiments, cinching apparatus 150 can automatically open and/or close the upper 120. For example, when the foot 102 is inserted into upper 120 and the wearer applies a sufficient weight load onto actuator system 131, actuator system 131 can automatically move the securement device 130 and close the upper 120 on the foot 102. Accordingly, cinching apparatus 150 can be considered a "weight activated cinching apparatus." In contrast, when the wearer removes footwear 100 and/or the weight load is reduced, cinching apparatus 150 can automatically open up the upper 120. As such, cinching apparatus 150 can allow footwear 100 to be conveniently closed and/or opened relative to the wearer's foot 102.

Referring now to FIGS. 1-6, cinching apparatus 150 will be discussed in greater detail. As mentioned, cinching apparatus 150 can include securement device 130. Securement device 130 can include one or more cables, cords, laces, wires, straps, pull tabs, clamps, hooks, or other devices that can be used for opening and closing the upper 120. In the embodiments of FIGS. 1-6, for example, securement device 130 can include a plurality of cables 132. Specifically, in some embodiments, securement device 130 can include a first cable 134, a second cable 136, a third cable 138, and a fourth cable 140. However, it will be appreciated that footwear 100 can include any number of cables 132. Moreover, it will be appreciated that securement device 130 can include devices other than cables without departing from the scope of the present disclosure.

In some embodiments, cables 132 can loop continuously from the medial side 115, over tongue 129, across lateral side 117, through sole structure 110, and back to medial side 115. Furthermore, as shown in FIG. 1, portions of cables 132 can be enclosed within article of footwear 100 and other portions can extend out of footwear 100 via a plurality of eyelets 142 formed in upper 120. In the illustrated embodiments, for example, segments of the cables 132 that extend over the tongue 129 can be exposed while other segments of the cables 132 can be enclosed within upper 120.

In some embodiments, when the upper 120 is in the open position of FIGS. 1 and 2, the cables 132 can be relatively loose, allowing the tongue 129 to be pivoted outward and away from adjacent areas of the upper 120. Then, when the cables 132 are pulled tight, the cables 132 can move the tongue 129 inward to move the upper 120 to the closed position of FIGS. 3 and 4. Thus, the upper 120 can be secured to the wearer's foot 102 when in the closed position. In contrast, when the cables 132 are loosened, the tongue 129 can move outward, causing the upper 120 to open up and allow removal of the foot 102. In additional embodiments, tightening of the cables 132 can cause the medial side 115 and lateral side 117 of the upper 120 to compress toward the foot 102, and loosening of the cables 132 can cause the medial side 115 and lateral side 117 of the upper 120 to move away from the foot 102.

Moreover, cinching apparatus 150 can generally include a spring pad 152. As shown in FIGS. 2, 4, 5, and 6, spring pad 152 can be disposed underneath the wearer's foot and can define a footbed that supports the foot. As such, spring pad 152 can partially define sole structure 110 in some embodiments. Spring pad 152 can also be supported by and connected to portions of sole structure 110 that are disposed underneath spring pad 152.

Spring pad 152 can be resilient and elastic. For example, spring pad 152 can bend elastically between a first position and a second position. Spring pad 152 is shown in a first or neutral position in FIGS. 2 and 5 according to some embodiments. Spring pad 152 is shown in a second position in FIGS. 4 and 6 according to some embodiments. Additionally, in some embodiments, spring pad 152 can be biased toward the first position.

In some embodiments, when the spring pad 152 is in the first position, spring pad 152 can at least partially curve and contour away from underlying portions of sole structure 110. In comparison, the spring pad 152 can be flatter when in the second position.

Portions of spring pad 152 can be fixed to the underlying portions of sole structure 110 in some embodiments while other portions can be moveable relative to the underlying portions. For example, in some embodiments, portions of spring pad 152 proximate forefoot region 111 can be fixed to underlying portions of sole structure 110, and portions within midfoot region 112 and heel region 114 can be moveable relative to sole structure 110.

Additionally, in some embodiments, heel region 114 of spring pad 152 can slide along underlying portions of the sole structure 110 as spring pad 152 moves between the first position and the second position. Specifically, in some embodiments, heel region 114 of spring pad 152 can maintain contact with underlying portions of sole structure 110 as spring pad 152 deflects.

Cinching apparatus 150 can also include an engagement member 154 that engages securement device 130. For example, as shown in FIGS. 2, 4, 5, and 6, cables 132 of securement device 130 can be received and attached to engagement member 154. Also, engagement member 154 can be configured to actuate the cables 132 and/or vary tension in the cables 132 to thereby open and close the upper 120. For example, as engagement member 154 moves in one direction, engagement member 154 can pull on the cables 132 to close the upper 120. In contrast, as engagement member 154 moves in the opposite direction, engagement member 154 can loosen the cables 132 and allow the upper 120 to open up.

In some embodiments, engagement member 154 can be associated with spring pad 152 such that movement of spring pad 152 causes movement of engagement member 154. Thus, bending of spring pad 152 can cause cables 132 to be pulled tight for closing the upper 120, and recovery of spring pad 152 can cause cables 132 to loosen for opening the upper 120.

The illustrated embodiments of cinching apparatus 150 shown in FIGS. 1-24 will now be discussed in greater detail. It will be appreciated that the illustrated embodiments are merely exemplary and that cinching apparatus 150 can vary without departing from the scope of the present disclosure.

Figure 7:
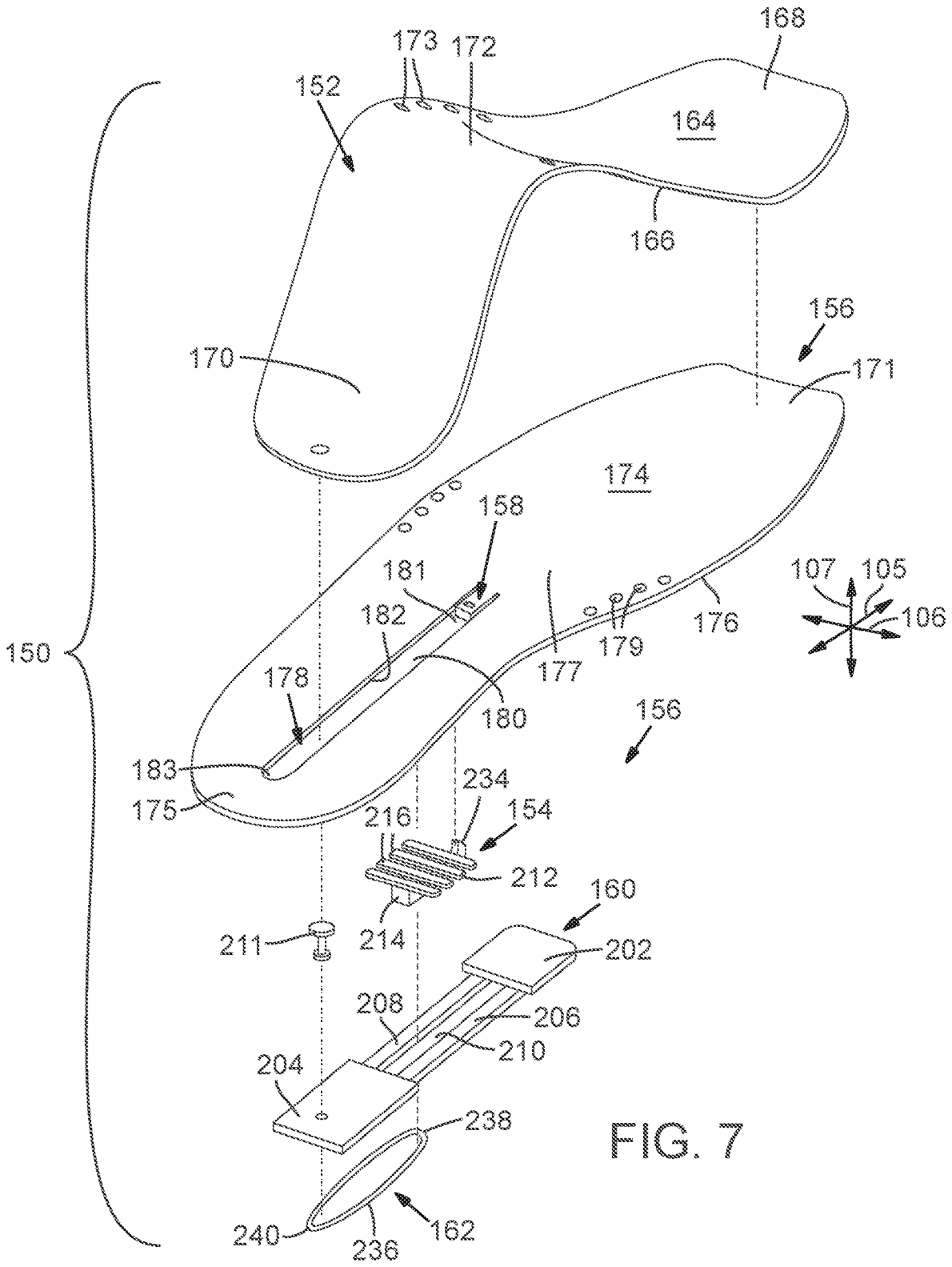
FIG. 7 is an exploded perspective view of the cinching apparatus.

As illustrated in the exploded view of FIG. 7, cinching apparatus 150 can include the spring pad 152 and the engagement member 154. Cinching apparatus 150 can further include a support member or base 156. Moreover, cinching apparatus 150 can include a locking mechanism 158, an abutment member 160, and a biasing member 162. Each of these components will be discussed individually according to exemplary embodiments. The function, interconnection, and interaction of these components will also be discussed according to exemplary embodiments.

Figure 8:
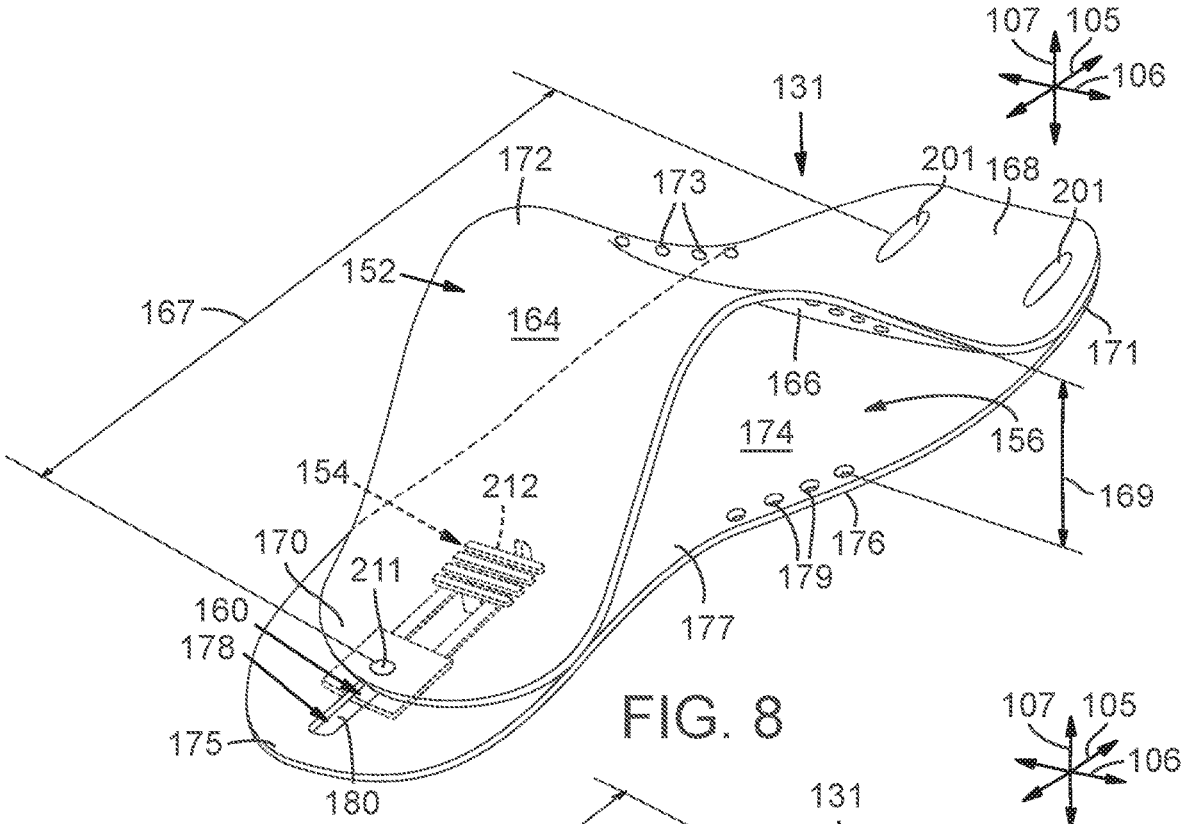
FIG. 8 is a perspective view of portions of the cinching apparatus shown in the first position.
Figure 9:
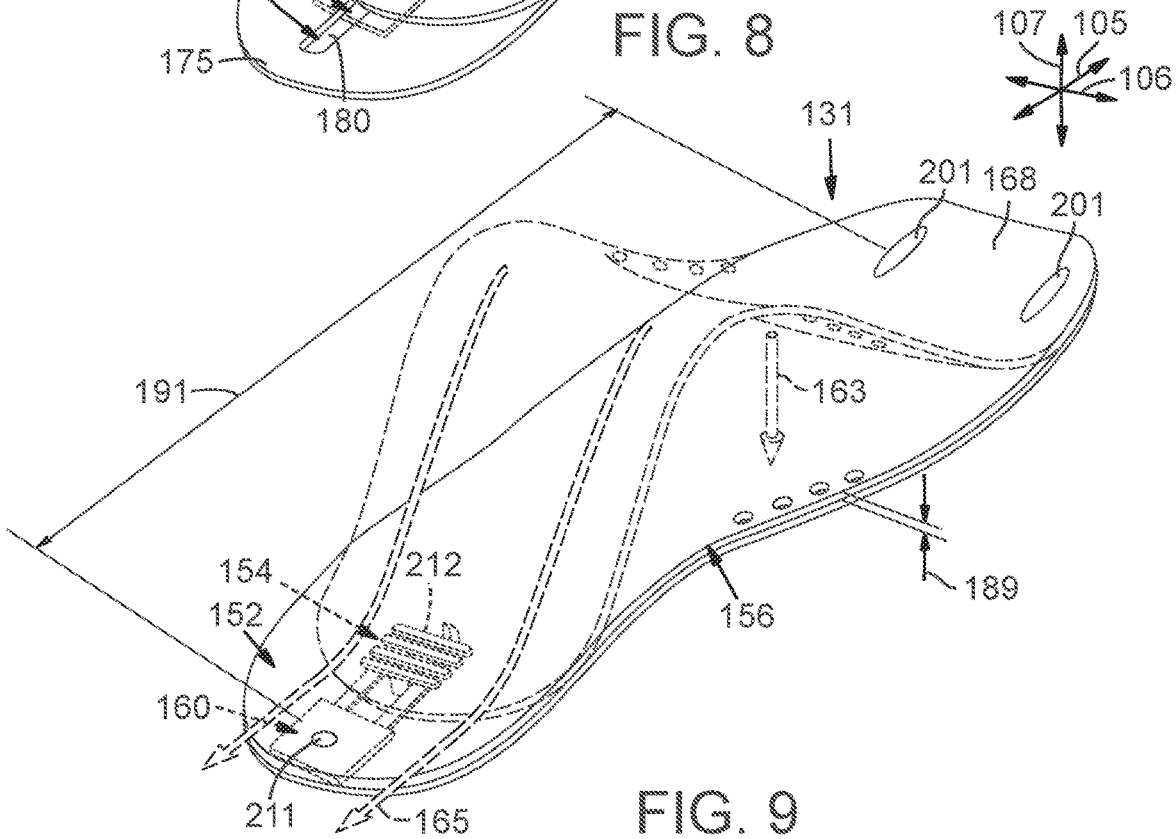
FIG. 9 is a perspective view of portions of the cinching apparatus shown in the second position.

Spring pad 152 is shown in FIGS. 7-9. Spring pad 152 can be a relatively thin sheet of one or more materials. In some embodiments, spring pad 152 can be made from a lightweight, flexible material, such as a polymer sheet, metal sheet, wood-based material, fiberglass, or other composite material. Spring pad 152 can also be made from a single material or from multiple materials. Also, in some embodiments, spring pad 152 can be a laminate of different layers of material.

Spring pad 152 can include a top surface 164 and a bottom surface 166. Top surface 164 can face generally toward upper 120, and bottom surface 166 can face away from top surface 164. In some embodiments, spring pad 152 can be a one-piece, unitary, or monolithic body. Spring pad 152 can also include a first portion 168, a second portion 170, and a third portion 172. First portion 168, and second portion 170 can be spaced apart at a distance 167. Third portion 172 can be disposed between first portion 168 and second portion 170. For example, third portion 172 can extend continuously between first portion 168 and second portion 170 along the longitudinal direction 105. Also, first portion 168 can be disposed in forefoot region 111 of sole structure 110, second portion 170 can be disposed in heel region 114 of sole structure 110, and third portion 172 can be disposed in midfoot region 112 of sole structure 110 in some embodiments. Thus, first portion 168 can be referred to as a "forefoot portion" of spring pad 152, second portion 170 can be referred to as a "heel portion" of spring pad 152, and third portion 172 can be referred to as a "midfoot portion" or "intermediate portion" of spring pad 152.

Spring pad 152 can exhibit a degree of rigidity or resistance to bending, for example, when spring pad 152 is in the first position illustrated in FIG. 7. However, spring pad 152 can be configured to resiliently flex, for example, when the wearer steps on or otherwise applies a weight load to spring pad 152. As a result, spring pad 152 can resiliently bend or otherwise deform from the first position of FIG. 8 to the second position of FIG. 9. Upon reduction and/or removal of the weight load, spring pad 152 can recover to the first position of FIG. 8.

In some embodiments, spring pad 152 can be substantially curved in the first position of FIG. 8, and spring pad 152 can be flatter in the second position of FIG. 9. For example, in some embodiments, spring pad 152 can be highly contoured and wave-shaped in the first position, and spring pad 152 can be substantially flat in the second position.

Spring pad 152 can be supported above base 156. In some embodiments, bottom surface 166 of spring pad 152 can partially abut base 156. Also, in some embodiments, spring pad 152 can be attached to base 156. For example, first portion 168 can sit flat against base 156 and first portion 168 can be fixed, or otherwise attached to base 156. Also, base 156 can support the deformation of spring pad 152 between the first position and the second position.

In some embodiments, spring pad 152 can be connected to base 156 at a first attachment 201. First attachment 201 can include one or more localized areas of attachment. Spring pad 152 and base 156 can be attached at first attachment 201 via a weld, adhesive, fastener(s) or any other attachment device. In some embodiments first portion 168 of spring pad 152 can be fixed to base 156 at first attachment 201.

Movement of spring pad 152 from the first position to the second position is illustrated in FIG. 9 and is indicated with arrows 165 and arrow 163. When moving between the first position and the second position, second portion 170 of spring pad 152 can move substantially in the longitudinal direction 105. For example, second portion 170 can move rearward in the longitudinal direction 105 when moving from the first position toward the second position. In contrast, second portion 170 can move forward in the longitudinal direction 105 when moving from the second position toward the first position. In some embodiments, second portion 170 can slide along and/or substantially remain in abutting contact with base 156 during deformation of spring pad 152.

Meanwhile, third portion 172 of spring pad 152 can move generally in the vertical direction 107 when moving between the first position and the second position. For example, in the first position of FIG. 8, third portion 172 of spring pad 152 can curve away from base 156. When moving to the second position, third portion 172 can move downward in the vertical direction 107. In some embodiments, third portion 172 can elastically bend and generally flatten toward base 156 as spring pad 152 moves from the first position to the second position. In contrast, third portion 172 can move upward in the vertical direction 107 and return to a curved state when moving from the second position toward the first position. As indicated in FIG. 8, third portion 172 can be spaced a distance 169 from base 156 when in the first position and as indicated in FIG. 9, third portion 172 can be spaced at a lesser distance 189 from base 156 when in the second position.

In some embodiments, when spring pad 152 is in the second position of FIG. 9, at least part of spring pad 152 can flatten against or conform to base 156. In other embodiments, one or more portions of spring pad 152 can remain spaced apart from base 156 when in the second position.

In some embodiments, spring pad 152 can substantially resist bending unless the load upon spring pad 152 exceeds a predetermined threshold. For example, the threshold can be approximately 10 pounds.

Additionally, in some embodiments, spring pad 152 can include one or more openings, such as through-holes 173. In some embodiments, through-holes 173 can extend substantially in the vertical direction 107 through spring pad 152. Stated differently, through-holes 173 can extend through both the top surface 164 and the bottom surface 166 of spring pad 152. In other embodiments, through-holes 173 can extend in the longitudinal direction 105 and/or the transverse direction 106 through the spring pad 152. As shown in FIG. 5, through-holes 173 can receive, retain, and/or route cables 132 through spring pad 152. Additionally, in the embodiment of FIG. 5, a plurality of through-holes 173 can be included on the medial side 115 of spring pad 152 and on the lateral side 117 of spring pad 152.

Referring now to FIGS. 16-19, embodiments of base 156 will be discussed in greater detail. In some embodiments, base 156 can be a substantially flat plate. In some embodiments, base 156 can be made from a wood-based material, fiberglass, composite material, plastic, or metal. Base 156 can also be made from a single material or from multiple materials. Also, in some embodiments, base 156 can be a laminate of different layers of material.

Base 156 can include an upper surface 174 and a lower surface 176. Furthermore, base 156 can include a forward area 171, which is disposed in the forefoot region 111 of sole structure 110. Base 156 can also include a rear area 175, which is disposed in the heel region 114 of sole structure 110. Also, base 156 can include an intermediate area 177, which is disposed in the midfoot region 112 of sole structure 110.

Base 156 can also include an opening 178. In some embodiments, opening 178 can be a slot 180 with a side surface 182 that extends between upper surface 174 and lower surface 176. Slot 180 can extend substantially in the longitudinal direction 105 and have a first end 181 disposed in rear area 175 and a second end 183 disposed in intermediate area 177. Slot 180 can have a substantially straight axis in some embodiments.

Additionally, in some embodiments, base 156 can include one or more openings, such as through-holes 179. In some embodiments, through-holes 179 can extend substantially in the vertical direction 107 through base 156. Stated differently, through-holes 179 can extend through both the upper surface 174 and the lower surface 176. In other embodiments, through-holes 179 can extend in the longitudinal direction 105 and/or the transverse direction 106 through the base 156. As shown in FIG. 5, through-holes 179 can receive, retain, and/or route cables 132 through base 156. In the embodiment of FIG. 5, a plurality of through-holes 173 can be included on the medial side 115 of base 156 and on the lateral side 117 of base 156.

Figure 16:
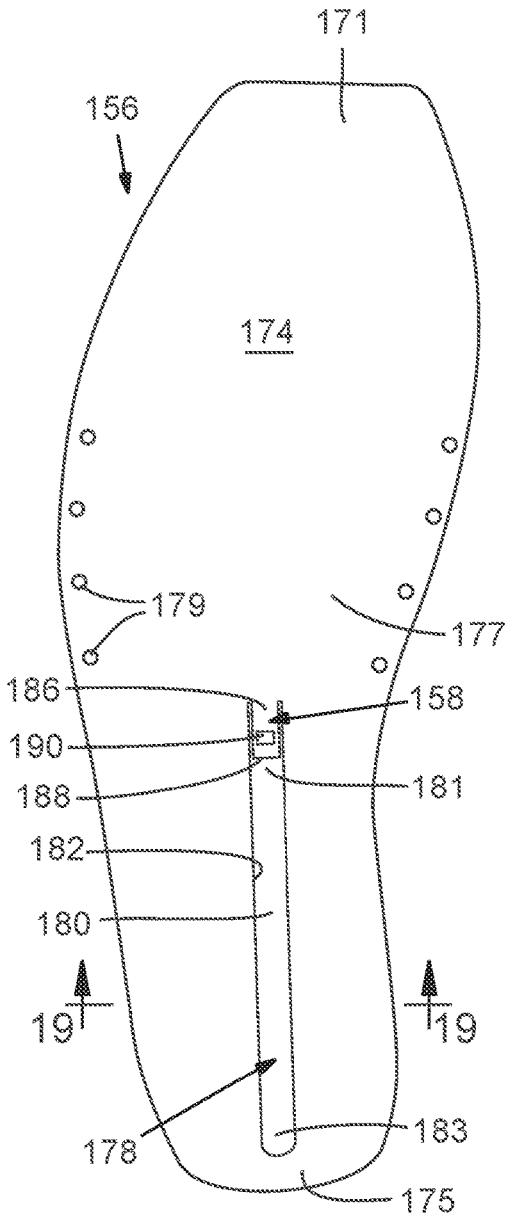
FIG. 16 is a top view of a base of the cinching apparatus.
Figure 17:
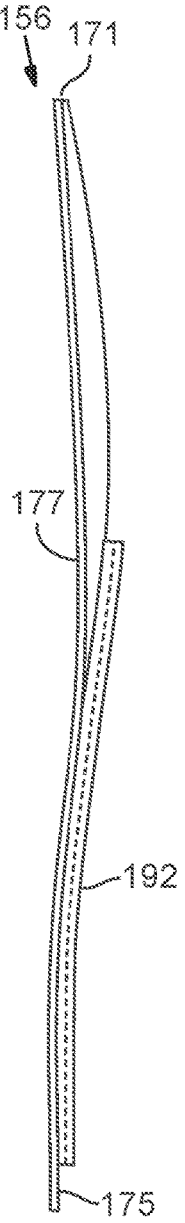
FIG. 17 is a side view of the base of FIG. 16.
Figure 18:
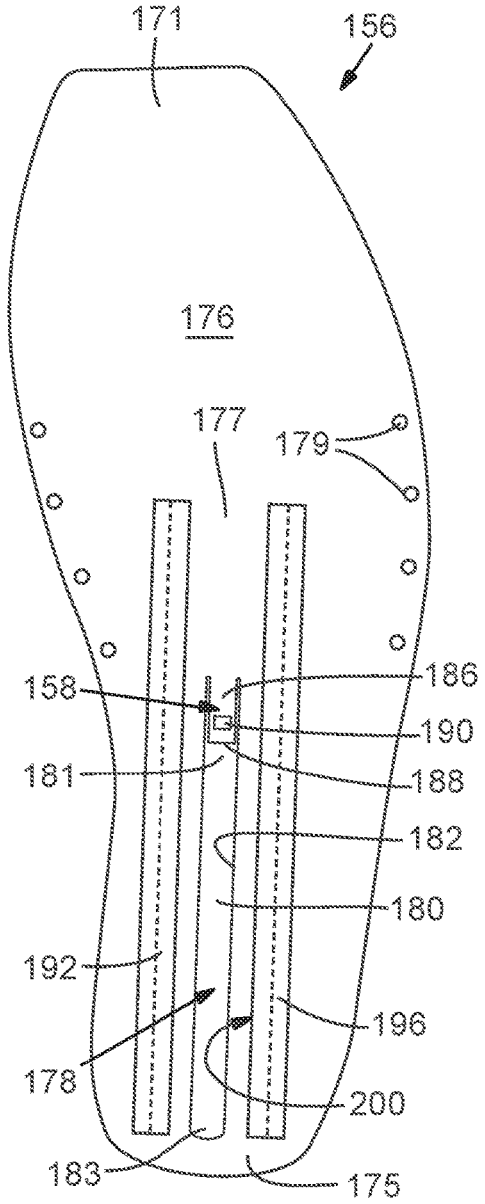
FIG. 18 is a bottom view of the base of FIG. 16.

As shown in FIGS. 16 and 18, base 156 can include the locking mechanism 158. Locking mechanism 158 can be of any type, such as a latch, a recess or other opening in base 156, a hook, or other device that is configured to retain engagement member 154. Generally, locking mechanism 158 can retain engagement member 154 to substantially maintain the upper 120 in either the open position or the closed position.

In some embodiments, locking mechanism 158 can be integrally attached to and defined on base 156. Specifically, locking mechanism 158 can be disposed proximate first end 181 of slot 180. For example, locking mechanism 158 can include a first end 186 that is attached to intermediate area 177 of base 156. Locking mechanism 158 can project rearwardly from intermediate area 177, and locking mechanism 158 can terminate at a second end 188, which is disposed within slot 180. Additionally, locking mechanism 158 can include an aperture 190. Aperture 190 can be a recess or hole. As will be discussed, locking mechanism 158 can be configured to removably latch onto engagement member 154.

Additionally, base 156 can include one or more rails that project from lower surface 176 and that extend along slot 180. These rails can provide attachment and can support movement of engagement member 154 and/or abutment member 160 relative to base 156. For example, base 156 can include a first rail 192 and a second rail 196. In some embodiments, first rail 192 and second rail 196 can extend on opposite sides of slot 180. Also, first rail 192 and second rail 196 can extend substantially parallel to slot 180.

Figure 19:
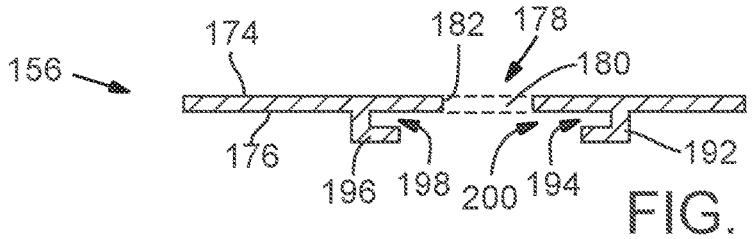
FIG. 19 is a section view of the base taken along the line 19-19 of FIG. 16.

Moreover, in some embodiments, first rail 192 can include a first recess 194 as shown in FIG. 19. Similarly, second rail 196 can include a second recess 198. First recess 194 and second recess 198 can cooperate to define a groove 200. Groove 200 can receive engagement member 154 and/or abutment member 160. Thus, in some embodiments, first rail 192 and second rail 196 can support movement of engagement member 154 and/or abutment member 160 as these components slide within the groove 200.

Figure 20:
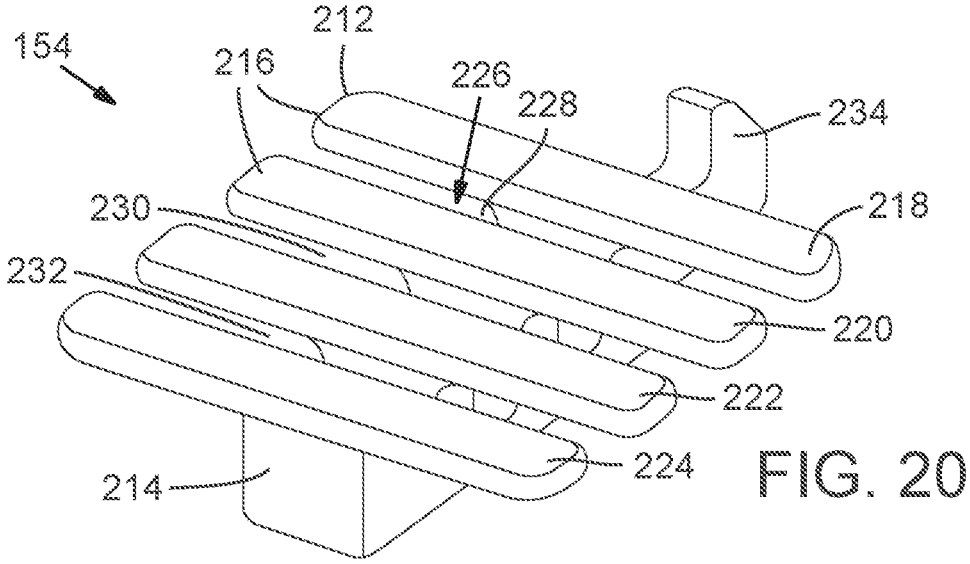
FIG. 20 is a perspective view of a shuttle of the cinching apparatus.
Figure 21:
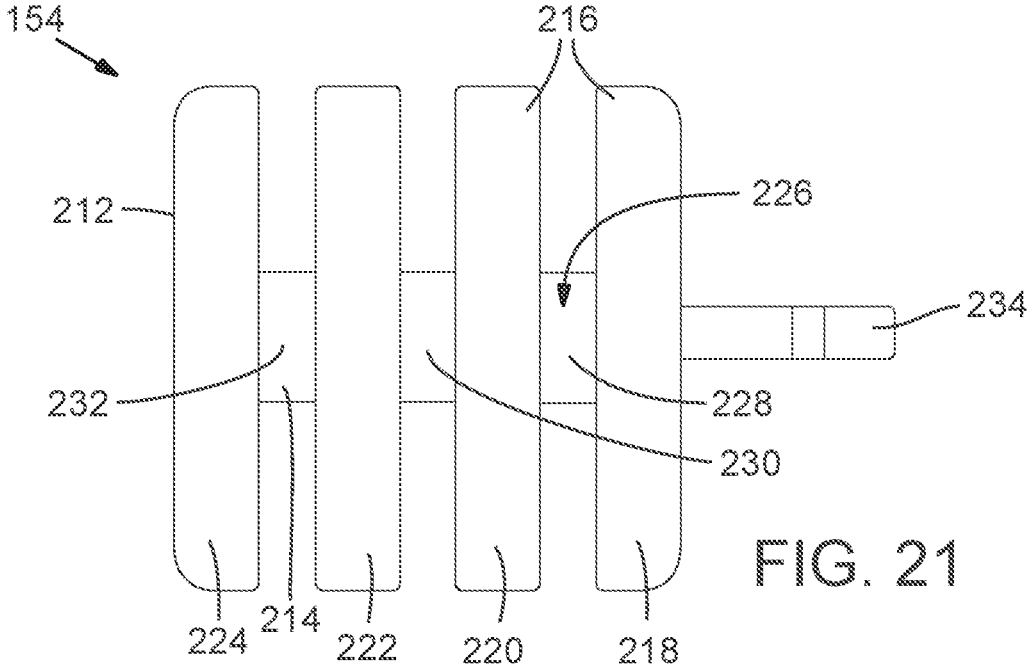
FIG. 21 is a top view of the shuttle of FIG. 20.
Figure 22:
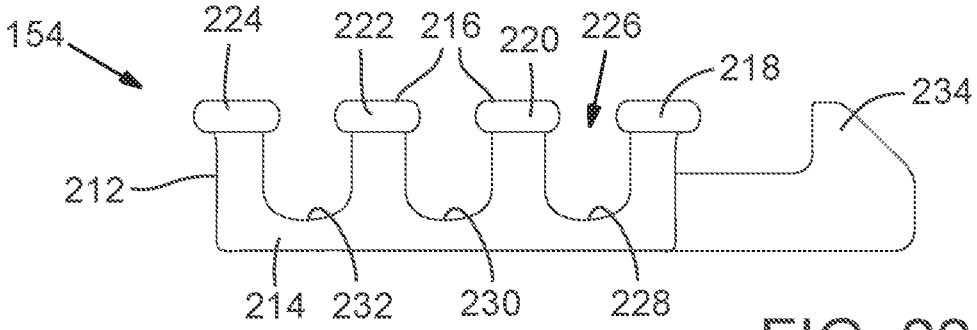
FIG. 22 is a side view of the shuttle of FIG. 20.

Referring now to FIGS. 20-22, engagement member 154 will be discussed in detail. In some embodiments, engagement member 154 can be referred to as a shuttle 212 that moves relative to base 156 to pull and/or push cables 132. Also, shuttle 212 can move to thereby increase tension and/or decrease tension in the cables 132.

Shuttle 212 can include an elongate spine 214. Also, shuttle 212 can include one or more ribs 216 that project from spine 214. For example, in some embodiments, shuttle 212 can include a first rib 218, a second rib 220, a third rib 222, and a fourth rib 224. Ribs 216 can be spaced apart along spine 214 and can project from each side of spine 214. Moreover, as shown in FIGS. 20-22, shuttle 212 can include one or more openings 226 between respective pairs of the ribs 216. For example, shuttle 212 can include a first opening 228, a second opening 230, and a third opening 232. In some embodiments, openings 226 can be recesses. However, openings 226 can be through-holes, notches, or other type of openings without departing from the scope of the present disclosure. First opening 228 can be a recess between first rib 218 and second rib 220. Second opening 230 can be a recess between second rib 220 and third rib 222. Third opening 232 can be a recess between third rib 222 and fourth rib 224.

In addition, shuttle 212 can include a hook 234. Hook 234 can project from spine 214 on the end opposite the third rib 222.

Shuttle 212 can be made from any suitable material. For example, shuttle 212 can be made from a strong, stiff, and durable material, such as metal, polymer, ceramic, or other material.

Figure 10:
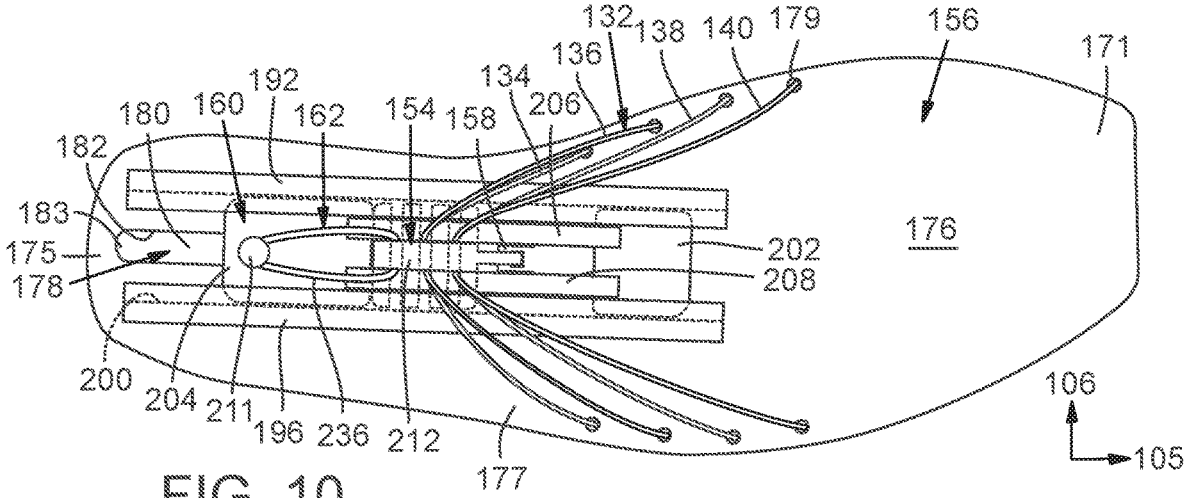
FIG. 10 is a bottom view of the cinching apparatus shown in the first position.
Figure 11:
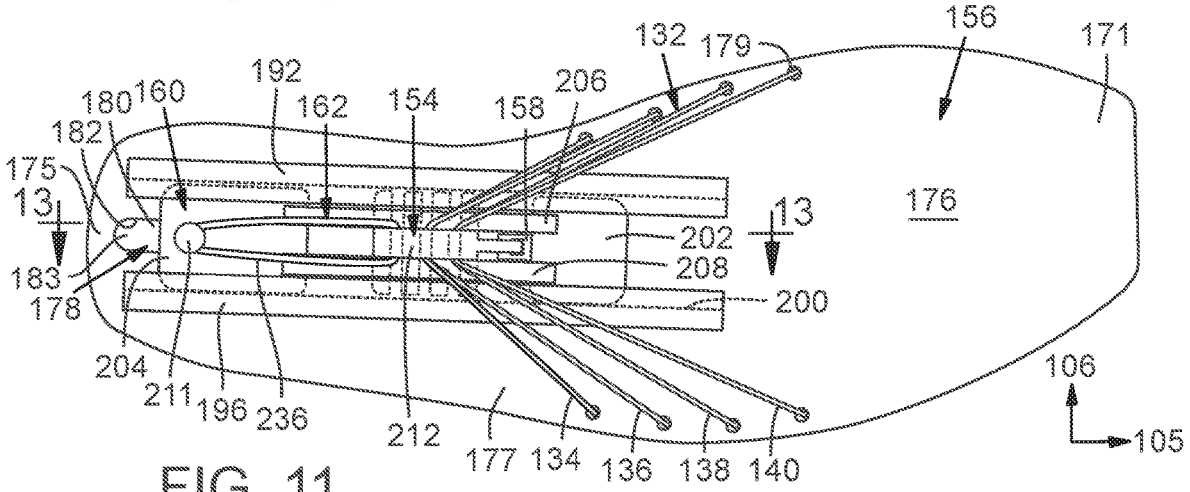
FIG. 11 is a bottom view of the cinching apparatus shown in an intermediate position.
Figure 12:
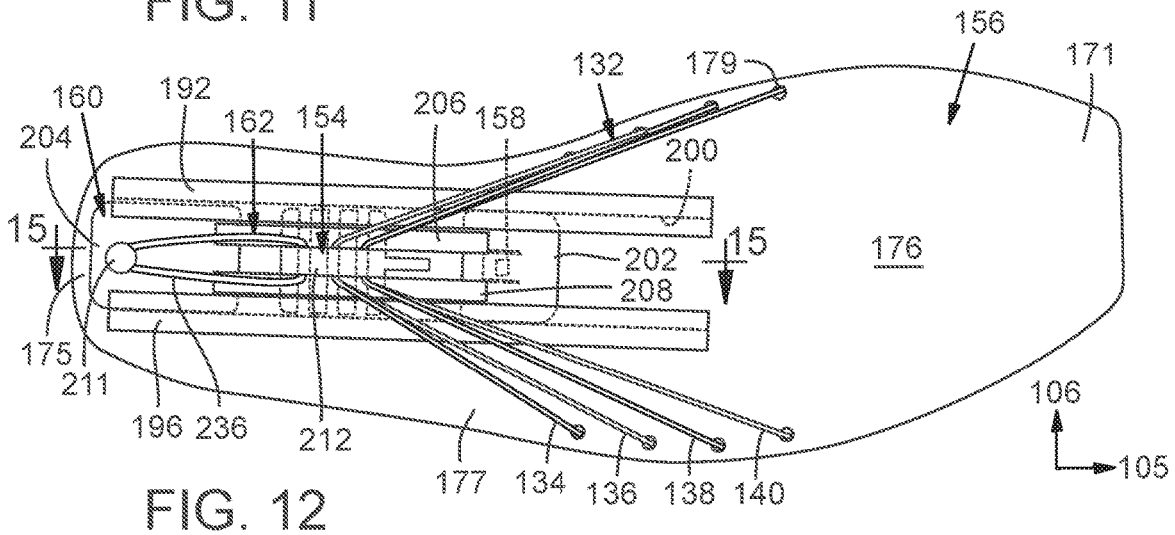
FIG. 12 is a bottom view of the cinching apparatus shown in the second position.

When shuttle 212 is assembled in cinching apparatus 150, ribs 216 of shuttle 212 can be received in groove 200 defined by rails 192, 196 as shown in FIGS. 10-12. Accordingly, ribs 216 and groove 200 can define a tongue-in-groove sliding-type attachment between shuttle 212 and base 156.

Figure 6:
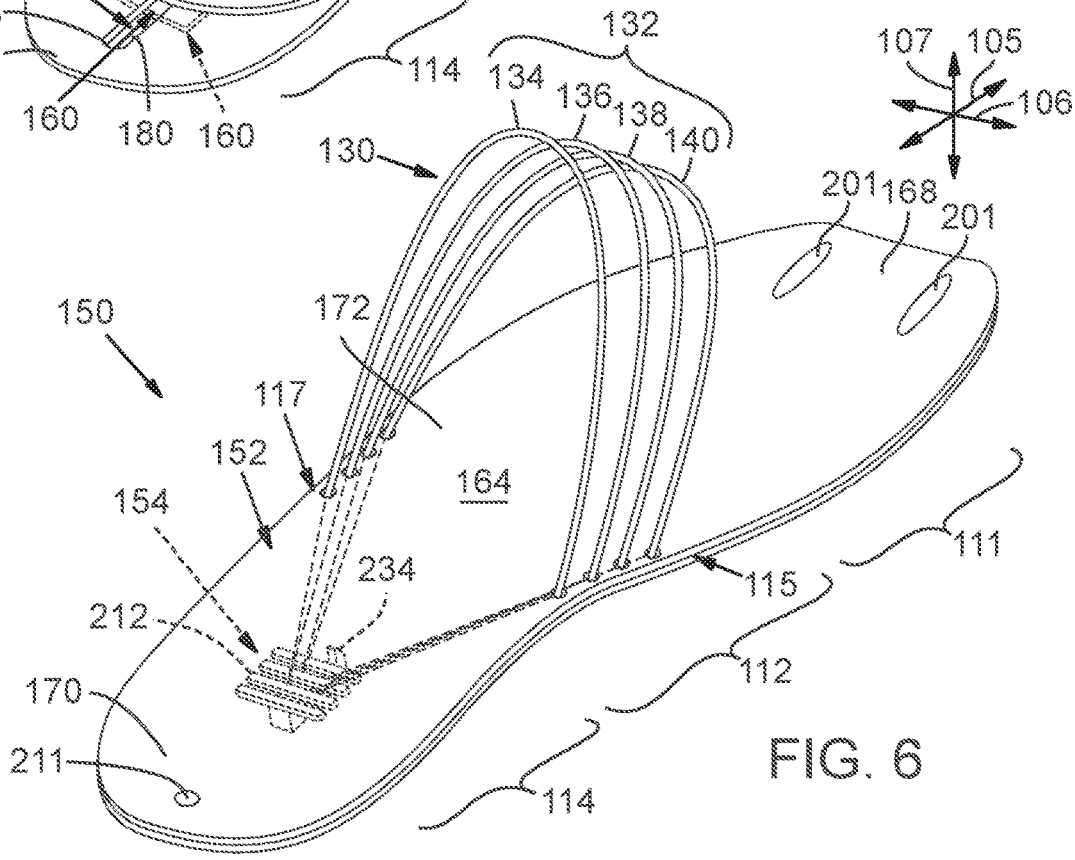
FIG. 6 is a perspective view of the cinching apparatus shown in the second position.

When spring pad 152 is in the first position, represented in FIGS. 5, 8, 10, and 13, shuttle 212 can be disposed in the midfoot region 112. As the spring pad 152 moves to the second position, shuttle 212 can slide along the groove 200 into the heel region 114 as shown in FIGS. 6, 9, and 12.

Figure 13:
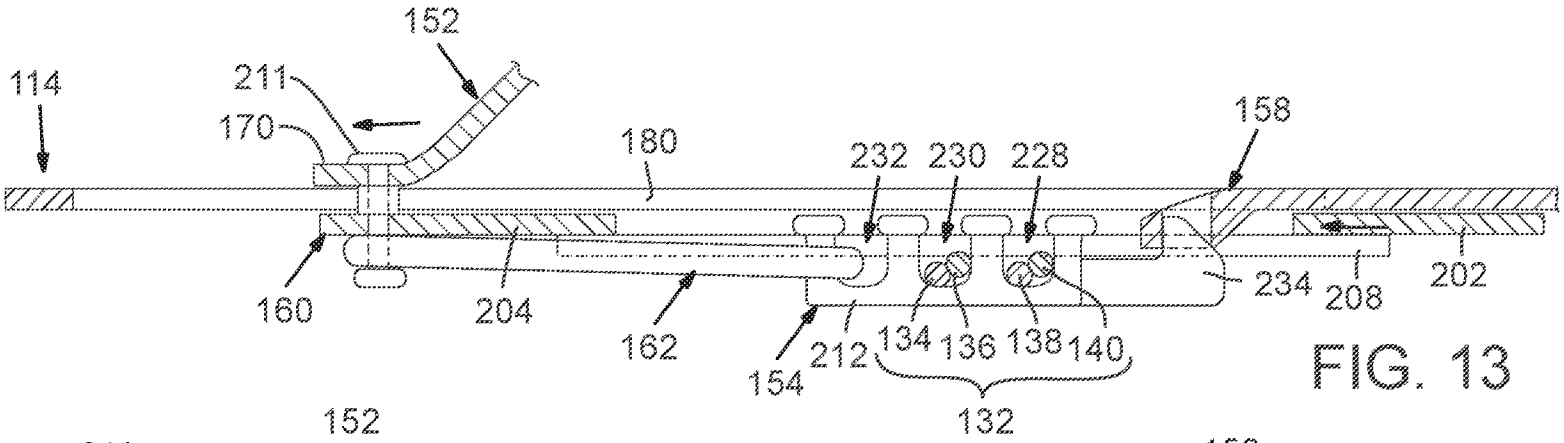
FIG. 13 is a section view of the cinching apparatus taken along the line 13-13 of FIG. 11.

Also, hook 234 can removably engage locking mechanism 158 as shown in FIGS. 10-15. More specifically, shuttle 212 can have a retained position, in which shuttle 212 is temporarily fixed in position relative to base 156 as shown in FIGS. 10, 11, and 13. Also, hook 234 can have a released position shown in FIGS. 12, 14, and 15, in which shuttle 212 is disengaged from locking mechanism 158 such that shuttle 212 can slide along groove 200 relative to base 156. As will be discussed, movement of shuttle 212 can be associated with the bending movement of spring pad 152.

Additionally, shuttle 212 can engage cables 132 of securement device 130. For example, cables 132 can be received in one or more openings 226 of shuttle 212. Also, in some embodiments, spine 214 and lower surface 176 of base 156 can cooperate to capture cables 132. Specifically, as shown in FIGS. 10-15, first cable 134 and second cable 136 can both be retained within second opening 230 of shuttle 212. Also, third cable 138 and fourth cable 140 can both be retained within first opening 228 of shuttle 212.

Accordingly, as shuttle 212 moves along groove 200, shuttle 212 can pull or otherwise increase tension in cables 132. Also, movement of shuttle 212 can decrease tension in cables 132 in some embodiments.

Figure 23:
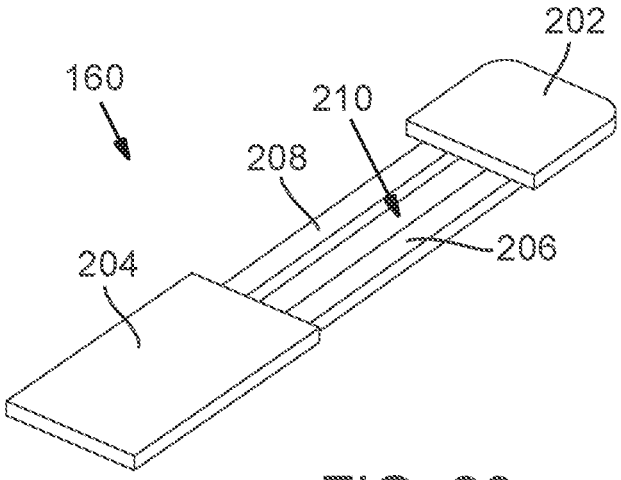
FIG. 23 is a perspective view of an abutment member of the cinching apparatus.
Figure 24:
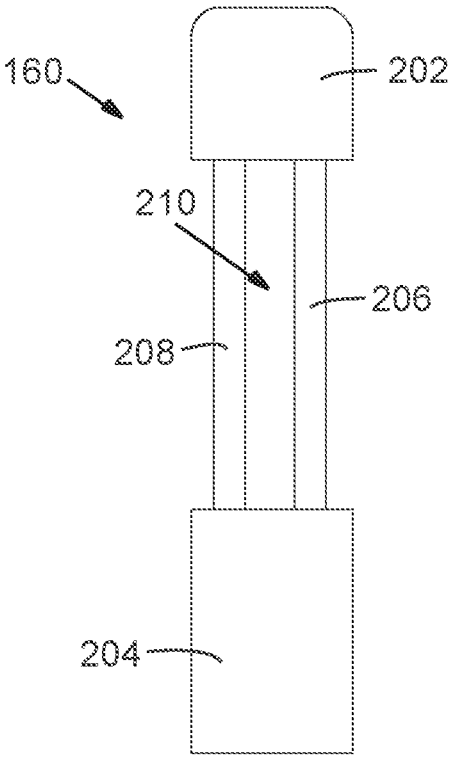
FIG. 24 is a top view of the abutment member of FIG. 19.
Figure 25:
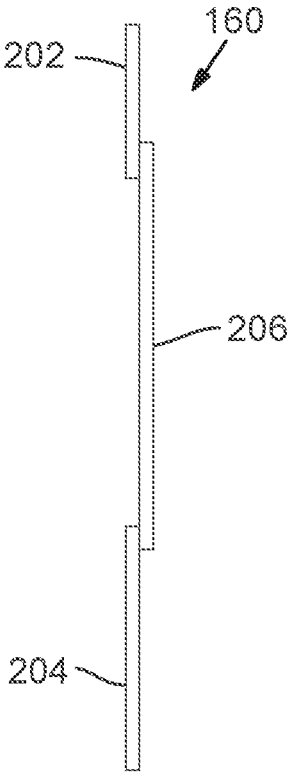
FIG. 25 is a side view of the abutment member of FIG. 19.

Referring now to FIGS. 23-25, abutment member 160 will be discussed in detail. Abutment member 160 can be relatively flat and can include a first pad 202 and a second pad 204. Abutment member 160 can also include a first arm 206 and a second arm 208. First arm 206 and second arm 208 can extend between first pad 202 and second pad 204. Also, first pad 202, second pad 204, first arm 206, and second arm 208 can cooperate to define an opening 210 through abutment member 160.

Abutment member 160 can be made out of any suitable material. For example, abutment member 160 can be made out of a polymeric or metallic material.

When abutment member 160 is assembled in cinching apparatus 150, first pad 202 and second pad 204 can be received in groove 200 defined by rails 192, 196 as shown in FIGS. 10-12. As such, abutment member 160 can slide along groove 200 in the longitudinal direction 105.

Additionally, abutment member 160 can be connected to spring pad 152. In some embodiments, abutment member 160 can be connected at a second attachment 211 to second portion 170 of spring pad 152. Abutment member 160 and spring pad 152 can be attached at second attachment 211 via a weld, adhesive, fastener(s) or any other attachment device. Furthermore, second attachment 211 can be achieved through slot 180 in base 156. Stated differently, second attachment 211 can extend through slot 180 and can move along slot 180. In some embodiments, second attachment 211 can abut against side surface 182 of slot 180 such that slot 180 guides movement of abutment member 160 in the longitudinal direction 105.

It will be appreciated that, in some embodiments, the distance between second attachment 211 and first attachment 201 can vary as spring pad 152 deforms. For example, the distance 191 between second attachment 211 and first attachment 201 can be greater in the second position illustrated in FIG. 9 as compared to the distance 167 shown in FIG. 8. Because of the second attachment 211, second portion 170 of spring pad 152 and abutment member 160 can move substantially in tandem. Specifically, second portion 170 of spring pad 152 and abutment member 160 can move in tandem in the longitudinal direction 105 in some embodiments.

Furthermore, shuttle 212 can be received in opening 210 of abutment member 160. As shown in FIG. 7, spine 214 can be received and can move within opening 210, and ribs 216 can be supported for sliding along first arm 206 and second arm 208. Also, with abutment member 160 received in groove 200 of base 156, abutment member 160 and base 156 can cooperate to retain shuttle 212 for movement along slot 180.

Figure 14:
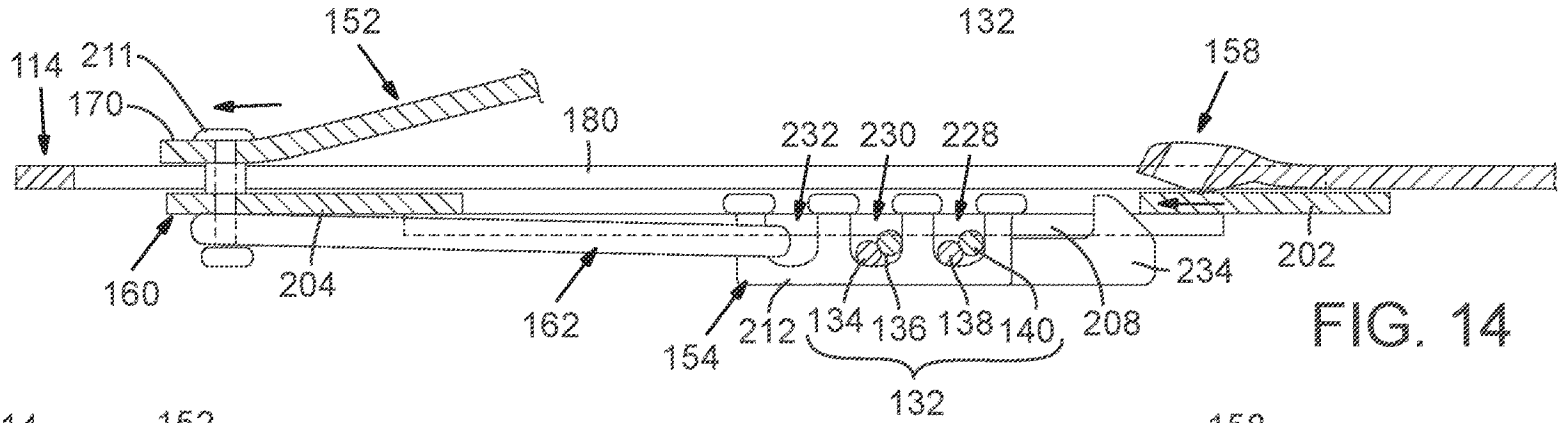
FIG. 14 is a section view of the cinching apparatus.
Figure 15:
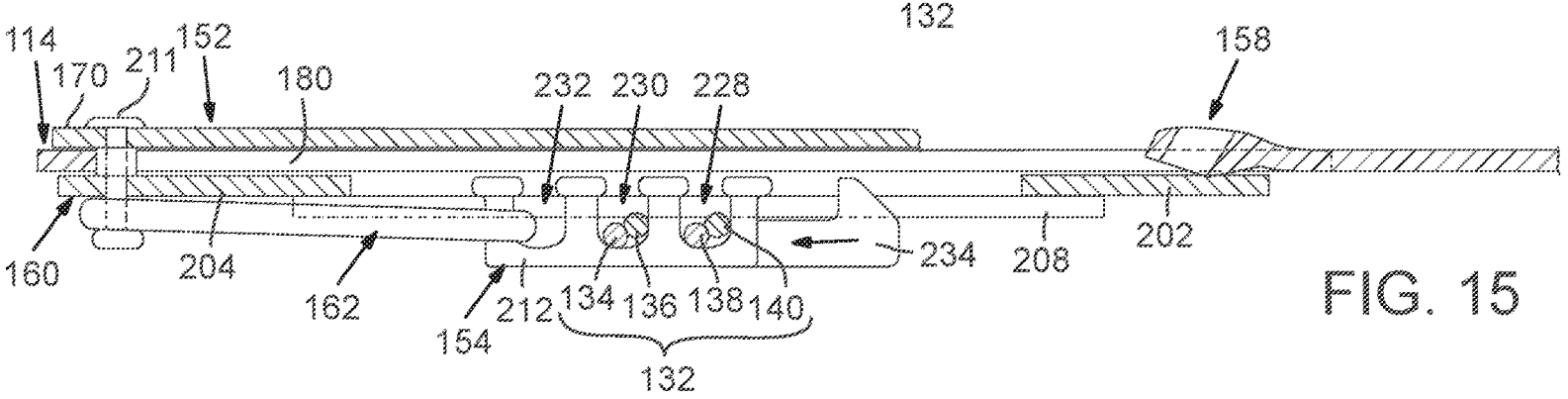
FIG. 15 is a section view of the cinching apparatus taken along the line 15-15 of FIG. 12.

Referring now to FIG. 7, biasing member 162 will be discussed in detail. In some embodiments, biasing member 162 can be an annular band 236 made out of elastic and stretchable material, such as rubber, stretchable yarn, or other material. Biasing member 162 can include a first portion 238 that is attached to shuttle 212. For example, biasing member 162 can be received and retained within third opening 232 of shuttle 212 as shown in FIGS. 13-15. Moreover, biasing member 162 can be attached to second pad 204 of abutment member 160 and/or spring pad 152, for example, at second attachment 211. Accordingly, biasing member 162 can associate movement of shuttle 212 to the movements of second attachment 211.

Referring now to FIGS. 1-4 and 10-15, operation of cinching apparatus 150 will be discussed. It will be assumed that cinching apparatus 150 is initially positioned in the first, neutral configuration represented in FIGS. 1, 2, 10, and 13. As the wearer inserts the foot 102 into the footwear 100 and applies a weight load to spring pad 152, spring pad 152 can elastically bend and deform from the first position to the flatter second position. Second portion 170 of spring pad 152 and abutment member 160 can begin to move rearward as shown in FIGS. 11 and 14. Also, shuttle 212 can remain latched to locking mechanism 158 as second portion 170 of spring pad 152 and abutment member 160 slide rearward. Thus, biasing member 162 can elastically stretch and bias shuttle 212 toward the unlatched position as shown in FIG. 11.

As second portion 170 of spring pad 152 and abutment member 160 slide rearward, first pad 202 of abutment member 160 can abut and push against locking mechanism 158, causing locking mechanism 158 to pivot upward away from hook 234 as shown in FIG. 14. Accordingly, shuttle 212 can disengage from locking mechanism 158. As a result, biasing member 162 can pull shuttle 212 away from locking mechanism 158 and toward second end 183 of slot 180. As shuttle 212 slides rearward, cables 132 can be pulled and tensioned to close the upper 120 on the wearer's foot 102 as represented in FIGS. 3, 4, and 6.

Then, when the wearer removes the foot or otherwise reduces the weight load on spring pad 152, spring pad 152 can recover back to the first position represented in FIGS. 1, 2, and 5, causing second attachment 211 and abutment member 160 to move forward along slot 180. As abutment member 160 is pushed forward by second attachment 211, second pad 204 can eventually abut and push shuttle 212 forward along slot 180. This movement of shuttle 212 can push cables 132 forward and tension in cables 132 can be reduced. Thus, the upper 120 can regain its open position of FIGS. 1 and 2. Also, in some embodiments, this movement can cause second pad 204 of abutment member 160 to push shuttle 212 such that hook 234 engages locking mechanism 158. With shuttle 212 locked in position and spring pad 152 in the contoured first position, cinching apparatus 150 can be ready for automatically re-tightening of the upper 120 on the wearer's foot.

Figure 26:
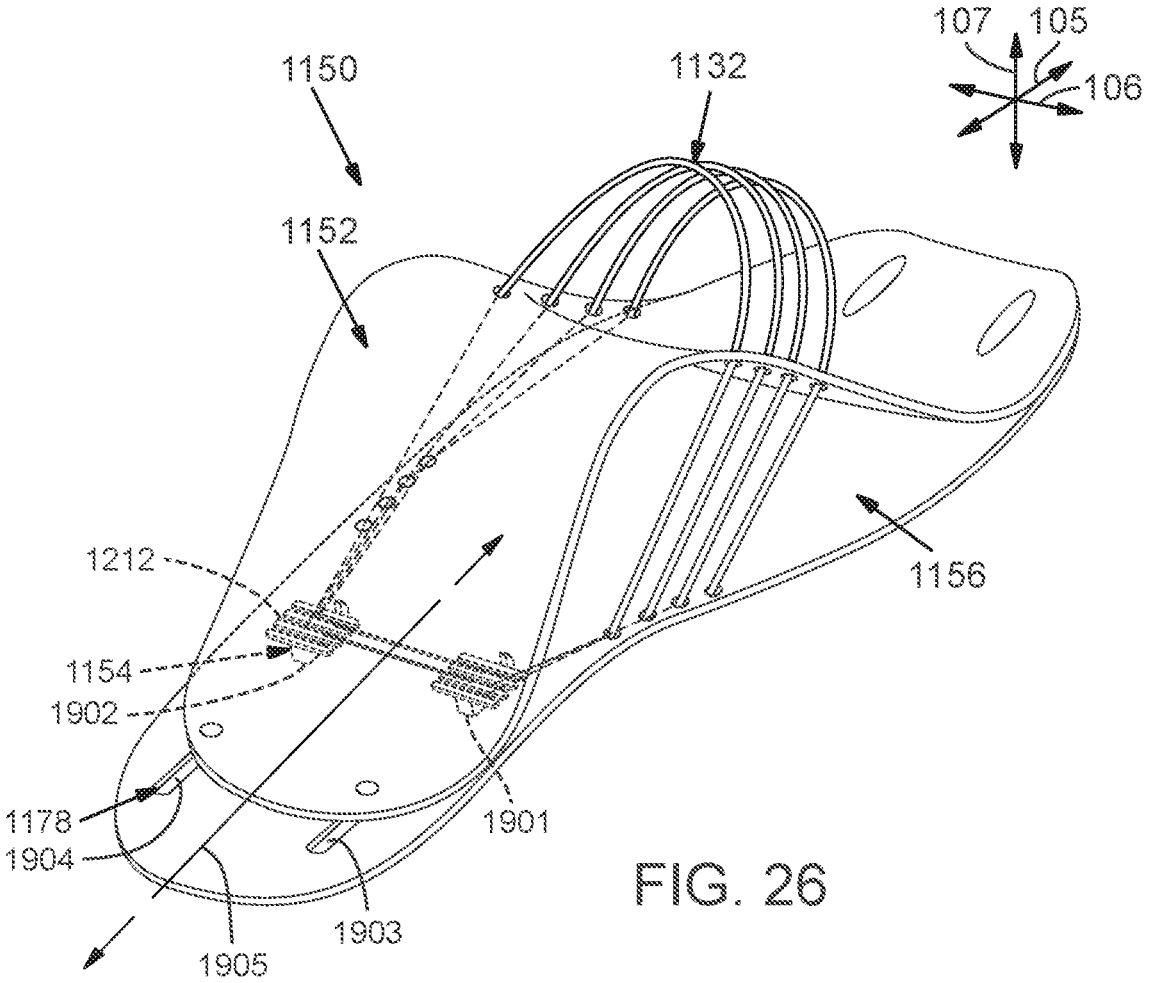
FIG. 26 is a perspective view of the cinching apparatus according to additional embodiments of the present disclosure.

Referring now to FIG. 26, cinching apparatus will be discussed according to additional embodiments. Cinching apparatus of FIG. 26 is identified generally at 1150. One or more components of cinching apparatus 1150 can correspond to those of the embodiments of FIGS. 1-25. Therefore, descriptions of those features will not be repeated. Components of FIG. 26 that correspond to components of FIGS. 1-25 are identified in FIG. 26 with corresponding reference numbers increased by 1000.

Cinching apparatus 1150 can include a plurality of engagement members 1154 or shuttles 1212. For example, apparatus 1150 can include a first shuttle 1901 and a second shuttle 1902. First shuttle 1901 can be disposed on the medial side of a central longitudinal axis 1905 of sole structure, and second shuttle 1902 can be disposed on the lateral side of the longitudinal axis 1905.

Additionally, base 1156 can include a corresponding number of slots 1180. For example, base 1156 can include a first slot 1903, which receives the first shuttle 1901, and a second slot 1904, which receives the second shuttle 1902.

It will be appreciated that cinching apparatus 1150 can include an abutment member of the type discussed above with respect to FIGS. 1-25. In some embodiments, apparatus 1150 can include a first abutment member that abuts against first shuttle 1901 and a second abutment member that abuts against second shuttle 1902. The abutment member(s) can operate as discussed above to unlatch and latch first shuttle 1901 and second shuttle 1902 to base 1156.

First shuttle 1901 and second shuttle 1902 can be spaced apart in the transverse direction 1106 from the longitudinal axis 1905 of the sole structure. As such, shuttle 1901, shuttle 1902, and abutment member(s) can be spaced apart from the central area of the heel of the wearer's foot. Thus, the wearer is unlikely to feel these components when walking, jumping, standing, or otherwise wearing the footwear. Also, this configuration can provide space for more padding or other midsole components to be included underneath the wearer's heel. Accordingly, the article of footwear can be more comfortable to wear.

Figure 27:
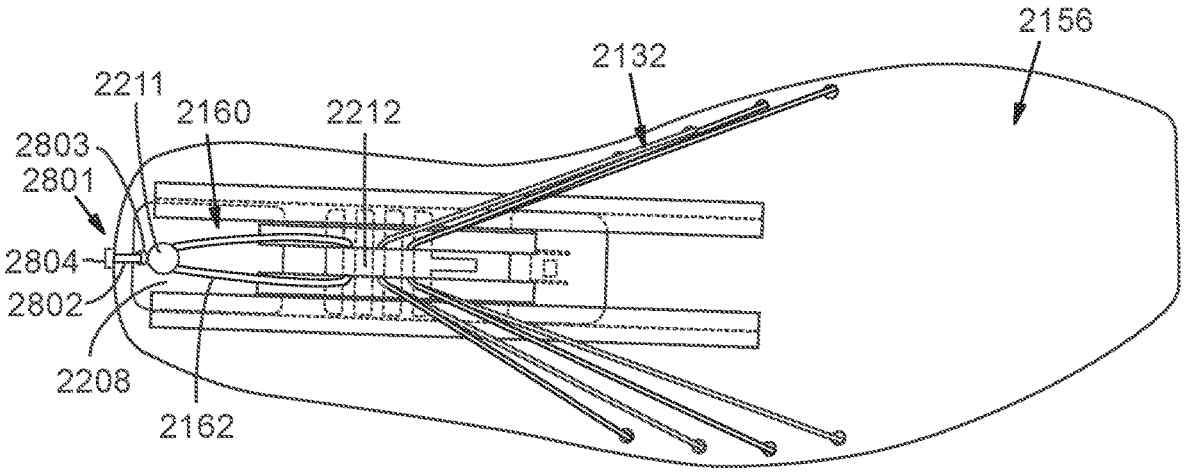
FIG. 27 is a bottom view of the cinching apparatus according to additional embodiments of the present disclosure, wherein the cinching apparatus is shown in the second position.
Figure 28:
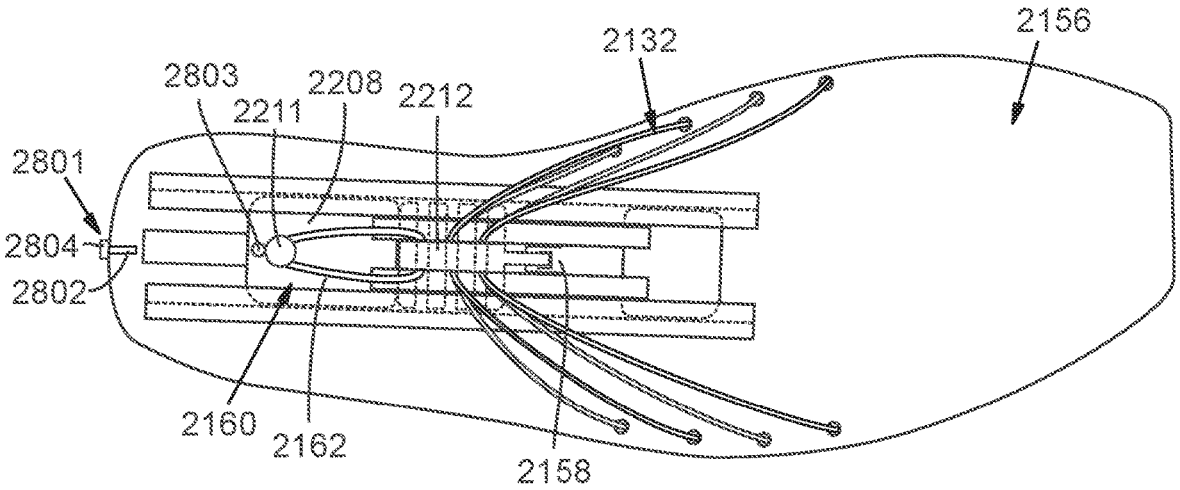
FIG. 28 is a bottom view of the cinching apparatus of FIG. 27, wherein the cinching apparatus is shown in the first position.

Referring now to FIGS. 27 and 28, cinching apparatus will be discussed according to additional embodiments. Cinching apparatus of FIGS. 27 and 28 are identified generally at 2150. One or more components of cinching apparatus 2150 can correspond to those of the embodiments of FIGS. 1-25. Therefore, descriptions of those features will not be repeated. Components of FIGS. 27 and 28 that correspond to components of FIGS. 1-25 are identified in FIGS. 27 and 28 with corresponding reference numbers increased by 2000.

As shown, cinching apparatus 2150 can include a second locking mechanism 2801. In some embodiments, locking mechanism 2801 can be included in addition to the locking mechanism 158 described above. In other embodiments, locking mechanism 2801 can be included as an alternative to locking mechanism 158.

Locking mechanism 2801 can be configured to retain and alternatively release another part of cinching apparatus 2150. In some embodiments, locking mechanism 2801 can be manually operated. As such, the wearer can selectively manipulate cinching apparatus 2150 to activate cinching apparatus 2150.

In some embodiments, locking mechanism 2801 can be configured to retain abutment member 2160 and/or spring pad in the second position. As such, locking mechanism 2801 can retain upper 120 in the tightened position against the wearer's foot.

Also, in some embodiments, locking mechanism 2801 can include an opening 2803 defined in second pad 2204 of abutment member 2160. Opening 2803 can be a hole or recess in some embodiments. Also, locking mechanism

2801 can include a retainer 2802, such as a hook, that is received in or otherwise engages opening 2803 as shown in FIG. 26. Additionally, locking mechanism 2801 can include a button, a lever, or other input device 2804 that the wearer can manipulate to actuate retainer 2802. Thus, the wearer can manipulate input device 2804 to remove retainer 2802 from opening 2803.

As shown in FIG. 28, when retainer 2802 is removed, biasing member 162 can bias abutment member 2160 toward shuttle 2212. Momentum of abutment member 2160 can bump abutment member 2160 into shuttle 2212, causing shuttle 2212 to engage locking mechanism 2158 as discussed above.

Accordingly, the locking mechanism 2801 can allow wearer to select when to move cinching apparatus 2150 from the second configuration to the first configuration. Stated differently, locking mechanism 2801 can allow wearer to select when to loosen upper from the foot.

While various embodiments of the present disclosure have been described, the description is intended to be exemplary, rather than limiting and it will be apparent to those of ordinary skill in the art that many more embodiments and implementations are possible that are within the scope of the present disclosure. Accordingly, the present disclosure is not to be restricted except in light of the attached claims and their equivalents. Also, various modifications and changes may be made within the scope of the attached claims.

We claim:

1. An article of footwear having a forefoot region and a heel region and defining a longitudinal direction that extends generally between the forefoot region and the heel region, the article of footwear comprising:

an upper having an open position and a closed position; and a cinching apparatus configured to move the upper between the open and closed positions, the cinching apparatus including:

a base having a base forefoot portion and a base heel portion; and a spring pad having a pad forefoot portion that is fixed in position relative to an upper surface of the base forefoot portion, a pad heel portion positioned adjacent an upper surface of the base heel portion and movable relative to the base heel portion generally in the longitudinal direction, and a pad midfoot portion between the pad forefoot portion and the pad heel portion, the pad midfoot portion being movable between a first position where the pad midfoot portion is at least partially curved in a direction away from the upper surface of the base midfoot portion and a second position where the pad midfoot portion is substantially flat relative to the upper surface of the base midfoot portion;

wherein when a load is applied to the pad midfoot portion the pad midfoot portion moves from the first position to the second position and when the load is removed from the pad midfoot portion the pad midfoot portion automatically returns to the first position;

wherein when the pad midfoot portion moves from the first position to the second position, the pad heel portion is configured to move generally in the longitudinal direction away from the pad forefoot portion and when the pad midfoot portion automatically moves from the second position to the first position, the pad heel portion is configured to move generally in the longitudinal direction toward the pad forefoot portion;

wherein when the pad midfoot portion moves from the first position to the second position, the cinching apparatus moves the upper from the open position to the closed position, and when the pad midfoot portion automatically moves from the second position to the first position, the cinching apparatus permits movement of the upper from the closed position to the open position.

2. The article of footwear of claim 1, further comprising a sole structure attached to upper, wherein the spring pad and base are included in the sole structure and configured to be disposed under the foot of a wearer, such that a weight load applied by a wearer moves the pad midfoot portion from the first position to the second position.

3. The article of footwear of claim 1, wherein the cinching apparatus further comprises:

an engagement member associated with the base heel portion and operatively coupled to the pad heel portion, the engagement member being configured to move generally in the longitudinal direction toward and away from the base forefoot portion; and a securement device engaging the engagement member and the upper, such that when the pad midfoot portion moves from the first position to the second position a tension on the securement device increases causing the upper to move from the open position to the closed position, and when the pad midfoot portion automatically moves from the second position to the first position the tension on the securement device decreases permitting movement of the upper from the closed position to the open position.

4. The article of footwear of claim 3, wherein the engagement member comprises a shuttle.

5. The article of footwear of claim 3, wherein the engagement member has a released position where the engagement member is freely movable and a locked position, and wherein the cinching apparatus further comprises a locking mechanism configured to lock the engagement member in the locked position such that the upper is substantially maintained in one of the open position and the closed position.

6. The article of footwear of claim 5, wherein the cinching apparatus further comprises an abutment member having a first end attached to the pad heel portion and operatively coupled to the engagement member, wherein the abutment member is configured to move substantially in tandem with the pad heel portion, and to release the locking mechanism as the pad midfoot portion moves from the first position toward the second position such that the engagement member is in the released position.

7. The article of footwear of claim 6, wherein the cinching apparatus further comprises a biasing member that engages the first end of the abutment member and the engagement member such that the biasing member biases the engagement member toward the first end of the abutment member.

8. The article of footwear of claim 6, wherein the base includes a groove extending in the longitudinal direction from the base heel portion toward the base midfoot portion, and configured to receive the abutment member such that the abutment member is capable of sliding within the groove.

9. The article of footwear of claim 3, wherein the securement device is at least one of a lace, a cable, a wire, and a strap.

10. The article of footwear of claim 1, wherein the spring pad is a one-piece unitary body, and wherein the pad midfoot portion extends continuously from the pad forefoot portion to the pad heel portion.

11. The article of footwear of claim 1, wherein the spring pad is made of a material that resists movement of the pad midfoot portion from the first position to the second position unless the load applied to the pad midfoot portion exceeds about 10 pounds.

12. An article of footwear including a forefoot region and a heel region, and defining a longitudinal direction that extends generally between the forefoot region and the heel region, the article of footwear comprising:

an upper having a closed position and an open position; and a cinching apparatus operatively coupled to the upper, the cinching apparatus including:

a base having a base forefoot portion and a base heel portion; and a spring pad having a pad forefoot portion, a pad heel portion, and an intermediate portion that is disposed between the pad forefoot portion and the pad heel portion, the pad forefoot portion being fixed in position relative to the base forefoot portion, the intermediate portion having a first position where the intermediate portion is curved in a direction of the upper and a second position where the spring pad is substantially flat, and the intermediate portion being configured to:

move from the first position toward the second position when a load is applied to the intermediate portion; and automatically return to the first position when the load is removed;

wherein the heel portion is configured to slide along the base in the longitudinal direction as the intermediate portion moves between the first position and the second position;

wherein as the intermediate portion moves from the first position to the second position, the cinching apparatus moves the upper from the open position and the closed position, and as the intermediate portion moves from the second position to the first position, the cinching apparatus permits the upper to move from the closed position to the open position.

13. The article of footwear of claim 12, further comprising a sole structure attached to upper, wherein the spring pad and base are included in the sole structure and configured to be disposed under the foot of a wearer, such that a weight load applied by a wearer moves the pad midfoot portion from the first position to the second position.

14. The article of footwear of claim 12, further comprising a securement device coupled to the upper and the cinching apparatus, the securement device being configured to move the upper from the open position to the closed position when the cinching apparatus applies tension to the securement device.

15. The article of footwear of claim 14, wherein the cinching apparatus further comprises an engagement member that engages the securement device, the engagement member being configured to apply the tension to the securement device.

16. The article of footwear of claim 15, wherein the engagement member applies tension to the securement device by moving generally in the longitudinal direction as the intermediate portion moves from the first position to the second position.

17. The article of footwear of claim 15, wherein the engagement member has a released position where the engagement member is freely movable and a locked position, and wherein the cinching apparatus further comprises a locking mechanism configured to lock the engagement member in the locked position such that the upper is substantially maintained in one of the open position and the closed position.

18. The article of footwear of claim 17, wherein the cinching apparatus further comprises an abutment member having a first end attached to the pad heel portion and operatively coupled to the engagement member, wherein the abutment member is configured to move substantially in tandem with the pad heel portion, and to release the locking mechanism as the pad midfoot portion moves from the first position toward the second position so that the engagement member is in the released position.

19. The article of footwear of claim 18, wherein the cinching apparatus further comprises a biasing member that engages the first end of the abutment member and the engagement member such that the biasing member biases the engagement member toward the first end of the abutment member.

20. The article of footwear of claim 14, wherein the securement device is at least one of a lace, a cable, a wire, and a strap.

21. The article of footwear of claim 12, wherein the spring pad is a one-piece unitary body, and wherein the intermediate portion of the spring pad extends continuously from the pad forefoot portion to the pad heel portion.

22. The article of footwear of claim 12, wherein the spring pad is made of a material that resists movement of the intermediate portion from the first position to the second position unless the load applied to the intermediate portion exceeds about 10 pounds.

* * * * *